US008384641B2

(12) United States Patent
Shimizu et al.

(10) Patent No.: US 8,384,641 B2
(45) Date of Patent: Feb. 26, 2013

(54) AMPLIFIER CIRCUIT AND DISPLAY DEVICE INCLUDING SAME

(75) Inventors: Shinsaku Shimizu, Suzhou Industrial Park (CN); Kazuhiro Maeda, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 849 days.

(21) Appl. No.: 12/310,028

(22) PCT Filed: Mar. 27, 2007

(86) PCT No.: PCT/JP2007/056291

§ 371 (c)(1),
(2), (4) Date: Feb. 6, 2009

(87) PCT Pub. No.: WO2008/023473

PCT Pub. Date: Feb. 28, 2008

(65) Prior Publication Data

US 2009/0295780 A1 Dec. 3, 2009

(30) Foreign Application Priority Data

Aug. 25, 2006 (JP) ..... 2006-229035

(51) Int. Cl.
*G09G 3/36* (2006.01)

(52) U.S. Cl. ..... 345/98; 345/211

(58) Field of Classification Search ..... 345/87–100, 345/204–215; 330/120, 122, 199–200, 250–293
See application file for complete search history.

(56) References Cited

U.S. PATENT DOCUMENTS 5,374,966 A * 12/1994 Weigand ..... 348/707
5,783,961 A * 7/1998 Zhou et al. ..... 327/85
6,137,741 A * 10/2000 Liu ..... 365/208

(Continued)

FOREIGN PATENT DOCUMENTS

CN 1777029 5/2006
JP 2003-068083 3/2003

(Continued)

*Primary Examiner* — Hong Zhou
(74) *Attorney, Agent, or Firm* — Harness, Dickey & Pierce, P.L.C.

(57) ABSTRACT

In one embodiment of the present application, during an initial setting period, switches are rendered conductive, so that voltage on a signal line becomes equal to a source voltage, and input voltages of inverters become equal to a logic threshold voltage. During a writing period, other switches are rendered conductive, and the inverters serve as amplifiers. The last-stage inverter is made up of a P-type Tr14, and an N-type Tr15 having a lower current drive capability than the P-type Tr14. At the beginning of the writing period, the voltage on the signal line varies due to current flowing through the P-type Tr14, and therefore the rate of change of the voltage on the signal line does not change by reducing the current drive capability of the N-type Tr15. On the other hand, by reducing the current drive capability of the N-type Tr15, the output resistance of the inverter increases, so that an amplifier circuit has frequency characteristics with an increased phase margin, resulting in reduced power consumption of the amplifier circuit.

12 Claims, 16 Drawing Sheets

U.S. PATENT DOCUMENTS

| | | | | |
|---|---|---|---|---|
| 6,456,282 | B1 * | 9/2002 | Karube | 345/204 |
| 6,639,575 | B1 * | 10/2003 | Tsunashima et al. | 345/92 |
| 7,436,385 | B2 * | 10/2008 | Kim et al. | 345/98 |
| 7,696,963 | B2 * | 4/2010 | Choi et al. | 345/82 |
| 2002/0190971 | A1 | 12/2002 | Nakamura et al. | |
| 2003/0189540 | A1 | 10/2003 | Itakura et al. | |
| 2004/0202276 | A1 | 10/2004 | Osame et al. | |
| 2005/0007325 | A1 * | 1/2005 | Kim et al. | 345/87 |
| 2005/0212560 | A1 * | 9/2005 | Hidaka | 326/83 |
| 2007/0139350 | A1 * | 6/2007 | Kawaguchi et al. | 345/100 |

FOREIGN PATENT DOCUMENTS

| | | |
|---|---|---|
| JP | 2004-219824 | 8/2004 |
| JP | 2005-257804 | 9/2005 |
| WO | WO 2004/057760 | 7/2004 |

* cited by examiner

AMPLIFIER CIRCUIT AND DISPLAY DEVICE INCLUDING SAME

TECHNICAL FIELD

The present invention relates to amplifier circuits for amplifying analog input signals and driving signal lines based on the amplified signals, and also to a display device using the amplifier circuits to drive data signal lines.

BACKGROUND ART

When driving a data signal line (also referred to as a "source line"), liquid crystal display devices use a method in which a D/A converter is used to convert a digital video signal into an analog video signal, and an amplifier circuit (also referred to as an "amplifier", an "output circuit", or an "analog buffer") provided at the subsequent stage of the D/A converter is used to amplify the analog video signal, which amplified signal is used to drive the data signal line. The reason for using this method is that the data signal line has a large capacitive component, and therefore voltage on the data signal line cannot be changed at a sufficient rate by simply driving the data signal line based on an output signal from the D/A converter.

Stability and low-power-consumption capability are required of the amplifier circuit for driving the data signal line. In addition, to perform highly accurate amplification with a negative feedback-type amplifier circuit, a high amplification factor is required. Accordingly, when a single amplifier is not able to achieve a desired amplification factor, a method with a plurality of cascaded amplifiers is used. However, in the case of amplifier circuits including a plurality of amplifiers, a phase delay occurs in the amplifier at each stage, and therefore it is necessary to perform phase compensation in order to prevent oscillation during application of negative feedback.

Regarding the phase compensation in the amplifier circuit including a plurality of amplifiers, the following techniques are conventionally known. Patent Document 1 describes an amplifier circuit configured by cascading three inverters, in which a resistive element and a capacitive element are provided in the second-stage inverter. Also, Patent Document 2 describes an amplifier circuit including an input amplification stage and an output amplification stage, in which a resistive circuit is interposed between an output terminal of the output amplification stage and a signal output terminal.

[Patent Document 1] Japanese Laid-Open Patent Publication No. 2003-255916

[Patent Document 2] Japanese Laid-Open Patent Publication No. 11-150427

DISCLOSURE OF THE INVENTION

Problems to be Solved by the Invention

However, the amplifier circuit described in Patent Document 1 has problems such as increased circuit complexity due to the resistive element and the capacitive element provided in the second-stage inverter, and high power consumption by the last-stage inverter. Also, the amplifier circuit described in Patent Document 2 has a problem where the rate of change (hereinafter, referred to as the "slew rate") of the voltage on the signal line decreases due to the resistive circuit provided for the output terminal of the output amplification stage.

Therefore, the present invention aims to provide an amplifier circuit having enhanced stability and low-power-consumption capability with the slew rate maintained, and also to provide a display device including the same.

Solution to the Problems

A first aspect of the present invention is directed to an amplifier circuit for amplifying an analog input signal and driving a signal line based on the amplified signal, the circuit including:

an amplifying portion including a plurality of cascaded amplifiers and negatively feeding back an output signal from the last-stage amplifier to an input to the first-stage amplifier;

a separation switch for selecting whether or not to supply an output signal from the amplifying portion to the signal line; and an initial setting switch for selecting whether or not to supply a first source voltage to the signal line, wherein the last-stage amplifier included in the amplifying portion includes a first transistor of a first conduction type having a source terminal supplied with the first source voltage and a gate terminal supplied with an output signal from the previous-stage amplifier, and a second transistor of a second conduction type having a source terminal supplied with a second source voltage and a gate terminal supplied with the same output signal from the previous-stage amplifier, and wherein the first transistor has a lower current drive capability than the second transistor.

In a second aspect of the present invention, based on the first aspect of the invention, the first transistor has a lower channel width-to-length ratio than the second transistor.

In a third aspect of the present invention, based on the first aspect of the invention, the amplifying portion includes:

an odd number of cascaded logical negation circuits, each serving as an amplifier;

threshold setting switches provided in association with their respective logical negation circuits for selecting whether or not to short-circuit input and output terminals of each logical negation circuit;

a feedback control switch for selecting whether or not to feed back an output signal from the last-stage logical negation circuit to an input to the first-stage logical negation circuit;

a first-stage capacitive element provided between an input terminal for the analog input signal and the input terminal of the first-stage logical negation circuit; and interstage capacitive elements provided between the input terminals of the logical negation circuits, excluding the first-stage logical negation circuit, and the output terminals of their previous-stage logical negation circuits.

In a fourth aspect of the present invention, based on the third aspect of the invention, the amplifying portion further includes an input capacitive element having an electrode connected to the input terminal of the first-stage logical negation circuit, and another electrode supplied with a constant voltage, and the input capacitive element has a capacitance value not allowing the threshold setting switch associated with the first-stage logical negation circuit to be rendered conductive when the feedback control switch is rendered conductive, provided that the analog input signal is at a level within a predetermined range.

In a fifth aspect of the present invention, based on the third aspect of the invention, the first-stage logical negation circuit included in the amplifying portion has a logic threshold voltage not allowing the threshold setting switch associated with the first-stage logical negation circuit to be rendered conductive when the feedback control switch is rendered conductive, provided that the analog input signal is at a level within a predetermined range.

In a sixth aspect of the present invention, based on the first aspect of the invention, the amplifying portion includes:

an odd number of cascaded logical negation circuits, each serving as an amplifier;

threshold setting switches provided in association with their respective logical negation circuits, excluding the last-stage logical negation circuit, for selecting whether or not to short-circuit input and output terminals of each logical negation circuit;

a feedback control switch for selecting whether or not to feed back an output signal from the last-stage logical negation circuit to an input to the first-stage logical negation circuit;

a first-stage capacitive element provided between an input terminal for the analog input signal and the input terminal of the first-stage logical negation circuit; and an interstage capacitive element provided between the input terminal of the logical negation circuits other than the first- and last-stage logical negation circuits and the output terminal of its previous-stage logical negation circuits.

In a seventh aspect of the present invention, based on the sixth aspect of the invention, the second-from-last-stage logical negation circuit included in the amplifying portion includes a third transistor of the first conduction type having a source terminal supplied with the first source voltage and a gate terminal supplied with an output signal from the previous-stage amplifier, and a fourth transistor of the second conduction type having a source terminal supplied with the second source voltage and a gate terminal supplied with the same output signal from the previous-stage amplifier, and the third transistor has a lower current drive capability than the fourth transistor.

In an eighth aspect of the present invention, based on the sixth aspect of the invention, the separation switch is made up of a single transistor having a conductive terminal connected to a drain terminal of the first transistor and another conductive terminal connected to a drain terminal of the second transistor.

In a ninth aspect of the present invention, based on the sixth aspect of the invention, the separation switch is made up of a single transistor having a conductive terminal supplied with the second source voltage and another conductive terminal connected to a drain terminal of the second transistor.

In a tenth aspect of the present invention, based on the sixth aspect of the invention, the amplifying portion further includes an input capacitive element having an electrode connected to the input terminal of the first-stage logical negation circuit and another electrode supplied with a constant voltage, and the input capacitive element has a capacitance value not allowing the threshold setting switch associated with the first-stage logical negation circuit to be rendered conductive when the feedback control switch is rendered conductive, provided that the analog input signal is at a level within a predetermined range.

In an eleventh aspect of the present invention, based on the sixth aspect of the invention, the first-stage logical negation circuit included in the amplifying portion has a logic threshold voltage not allowing the threshold setting switch associated with the first-stage logical negation circuit to be rendered conductive when the feedback control switch is rendered conductive, provided that the analog input signal is at a level within a predetermined range.

In a twelfth aspect of the present invention, based on the first aspect of the invention, the amplifying portion includes:

a logical negation circuit serving as the last-stage amplifier;

a threshold setting switch for selecting whether or not to short-circuit input and output terminals of the logical negation circuit;

a differential amplifier for inverting and amplifying the difference between the analog input signal and an output signal from the logical negation circuit;

a feedback control switch for selecting whether or not to provide the output signal from the logical negation circuit to the differential amplifier: and an interstage capacitive element provided between an inverted output terminal of the differential amplifier and the input terminal of the logical negation circuit.

In a thirteenth aspect of the present invention, based on the twelfth aspect of the invention, the amplifying portion further includes:

a first-stage capacitive element having an electrode connected to a negative-side input terminal of the differential amplifier;

an amplifier control switch for selecting whether or not to short-circuit the negative-side input terminal and a non-inverted output terminal of the differential amplifier; and an input control switch for selecting whether or not to provide the analog input signal to the other electrode of the first-stage capacitive element.

In a fourteenth aspect of the present invention, based on the twelfth aspect of the invention, the amplifying portion further includes:

a first-stage capacitive element having an electrode connected to a positive-side input terminal of the differential amplifier and another electrode provided with the analog input signal;

an amplifier control switch for selecting whether or not to short-circuit the positive-side input terminal and the inverted output terminal of the differential amplifier; and an input control switch for selecting whether or not to provide the analog input signal to the negative-side input terminal of the differential amplifier.

A fifteenth aspect of the present invention is directed to a matrix-type display device including:

a plurality of two-dimensionally arranged pixel circuits;

a plurality of data signal lines commonly connected to the pixel circuits arranged in the same column; and a data signal line drive circuit including an amplifier circuit of any of the first through fourteenth aspects of the invention, and driving the data signal lines using the amplifier circuit.

Effect of the Invention

According to the first aspect of the present invention, when alternately rendering the initial setting switch and the separation switch conductive, the voltage on the signal line varies for a while after the separation switch is rendered conductive, due to current flowing through the second transistor included in the last-stage amplifier. Accordingly, the rate of change of the voltage on the signal line does not change by reducing the current drive capability of the first transistor. On the other hand, by reducing the current drive capability of the first transistor, the output resistance of the last-stage amplifier increases, so that the amplifier circuit has frequency characteristics with an increased phase margin, resulting in reduced power consumption of the amplifier circuit. As such, it is possible to enhance stability and low-power-consumption capability of the amplifier circuit, while maintaining the slew rate.

According to the second aspect of the present invention, it is possible to configure the last-stage amplifier including the second transistor, and the first transistor having a lower current drive capability than the second transistor.

According to the third aspect of the present invention, it is possible to configure the amplifying portion using n (where n is an odd number) logical negation circuits, n threshold setting switches, n capacitive elements (first-stage and interstage capacitive elements), and a feedback control switch, making it possible to enhance stability and low-power-consumption capability of an amplifier circuit configured by cascading the n logical negation circuits, while maintaining the slew rate.

According to the fourth or fifth aspect of the present invention, when the feedback control switch is rendered conductive, along with the separation switch, the threshold setting switch associated with the first-stage logical negation circuit is prevented from being rendered conductive, making it possible to prevent any amplification error.

According to the sixth aspect of the present invention, it is possible to configure the amplifying portion using n (where n is an odd number) logical negation circuits, (n−1) threshold setting switches, (n−1) capacitive elements (first-stage and interstage capacitive elements), and a feedback control switch, making it possible to enhance stability and low-power-consumption capability of an amplifier circuit configured by cascading the n logical negation circuits, while maintaining the slew rate. In addition, no threshold setting switch and interstage capacitive element are provided in association with the last-stage logical negation circuit, and therefore it is possible to reduce circuit complexity by a corresponding degree.

According to the seventh aspect of the present invention, by adjusting the logic threshold voltage of the second-from-last-stage logical negation circuit, the amplification factor of the last-stage logical negation circuit can be prevented from decreasing excessively.

According to the eighth or ninth aspect of the present invention, by using the separation switch made up of a single transistor, the circuit complexity of the amplifier circuit can be reduced.

According to the tenth or eleventh aspect of the present invention, when the feedback control switch is rendered conductive, along with the separation switch, the threshold setting switch associated with the first-stage logical negation circuit is prevented from being rendered conductive, making it possible to prevent any amplification error.

According to the twelfth aspect of the present invention, it is possible to configure the amplifying portion using a logical negation circuit and a differential amplifier, making it possible to enhance stability and low-power-consumption capability of an amplifier circuit configured by cascading the differential amplifier and the logical negation circuit, while maintaining the slew rate.

According to the thirteenth or fourteenth aspect of the present invention, it is possible to suitably control the amplifier control switch and the input control switch to invert and amplify the difference between the analog input signal and the output signal from the logical negation circuit in the differential amplifier.

According to the fifteenth aspect of the present invention, the data signal lines are driven using the amplifier circuit having enhanced stability and low-power-consumption capability with the slew rate maintained, and therefore it is possible to enhance image quality and low-power-consumption capability of a display device, while maintaining display speed.

DESCRIPTION OF THE REFERENCE CHARACTERS

Figure 1:
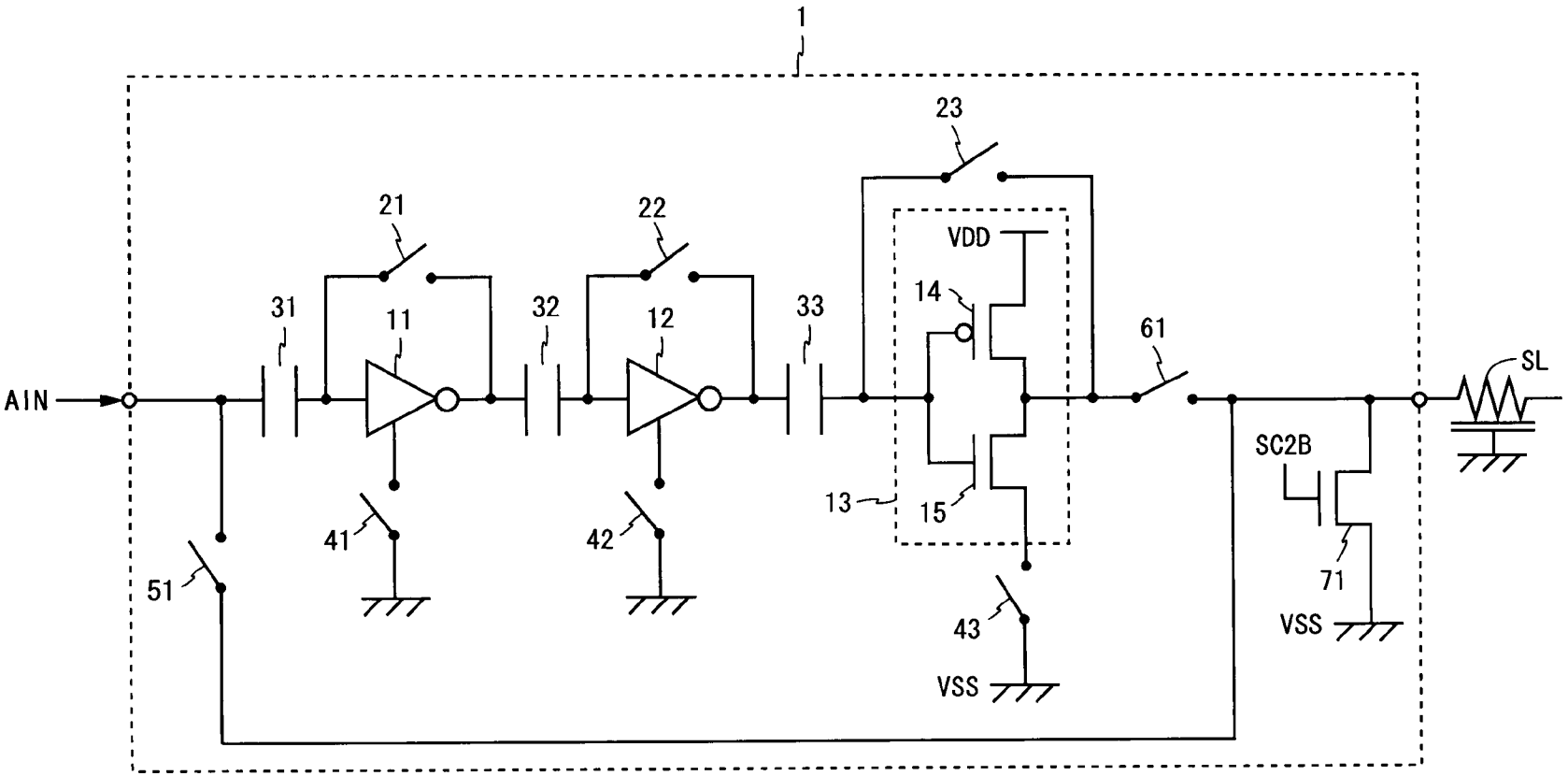
FIG. 1 is a circuit diagram for an amplifier circuit according to a first embodiment of the present invention.

1, 2, 3, 4, 5, 6, 7, 240 amplifier circuit
11, 12, 13, 16, 17 inverter
14 P-type transistor
15 N-type transistor
18 differential amplifier
21, 22, 23, 24, 25 switch
31, 32, 33, 34, 35 capacitor
41, 42, 43 stop control switch
51 feedback control switch
61, 62 separation switch
71 initial setting switch

100, 200 liquid crystal panel
110 pixel array
111 pixel circuit
112 data signal line
113 scanning signal line
120 data signal line drive circuit
121, 221 shift register
122, 124 latch
123, 230 D/A converter
125 data selection portion
126 selection switch
220 part of data signal line drive circuit
222 analog switch

BEST MODE FOR CARRYING OUT THE INVENTION

First Embodiment

FIG. 1 is a circuit diagram for an amplifier circuit according to a first embodiment of the present invention. The amplifier circuit 1 shown in FIG. 1 uses a plurality of cascaded amplifiers (inverters) to amplify an analog input signal AIN and drive a signal line SL based on the amplified signal (details will be described later). The amplifier circuit 1 is used, for example, when driving a data signal line in a liquid crystal display device.

Figure 2:
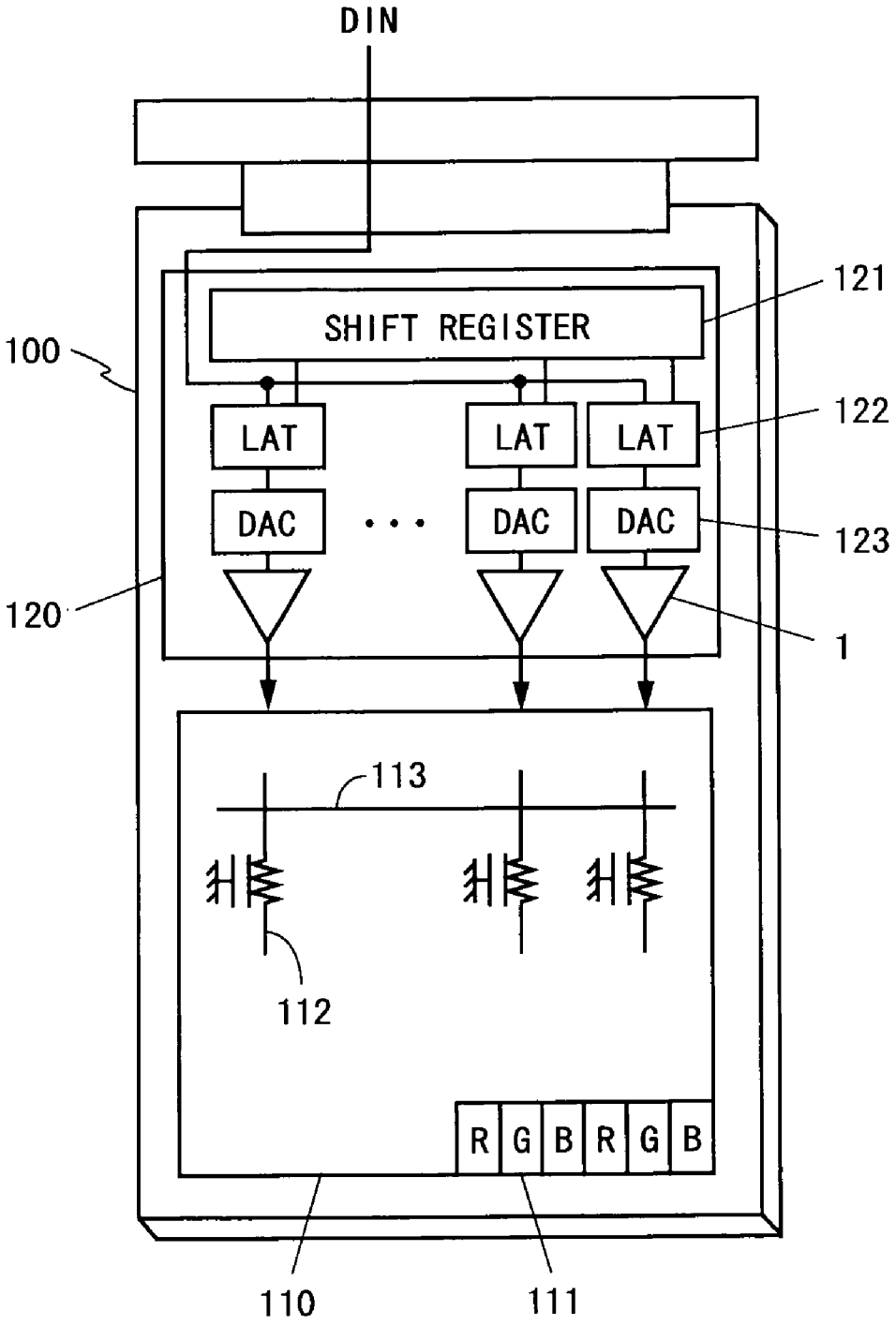
FIG. 2 is a block diagram illustrating the configuration of a liquid crystal display device according to the first embodiment of the present invention.

FIG. 2 is a block diagram illustrating the configuration of a liquid crystal display device including the amplifier circuits 1. The liquid crystal display device shown in FIG. 2 has a pixel array 110, a data signal line drive circuit 120, and a scanning signal line drive circuit (not shown) integrally formed on a liquid crystal panel 100. The pixel array 110 includes a plurality of two-dimensionally arranged pixel circuits 111, a plurality of data signal lines 112, and a plurality of scanning signal lines 113. The data signal lines 112 are each connected commonly to the pixel circuits 111 arranged in the same column, whereas the scanning signal lines 113 are each connected commonly to the pixel circuits 111 arranged in the same row.

The scanning signal line drive circuit sequentially selects and activates the scanning signal lines 113, thereby sequentially selecting the pixel circuits 111 for one row. The data signal line drive circuit 120 drives the data signal lines 112 in a line-sequential manner based on digital video signals DIN. Hereinafter, it is assumed that the pixel array 110 includes m (where m is an integer of 2 or more) data signal lines 112, and the digital video signal DIN is a k-bit signal. Also, an interval in which the digital video signal DIN changes is referred to as a "cycle".

Figure 3:
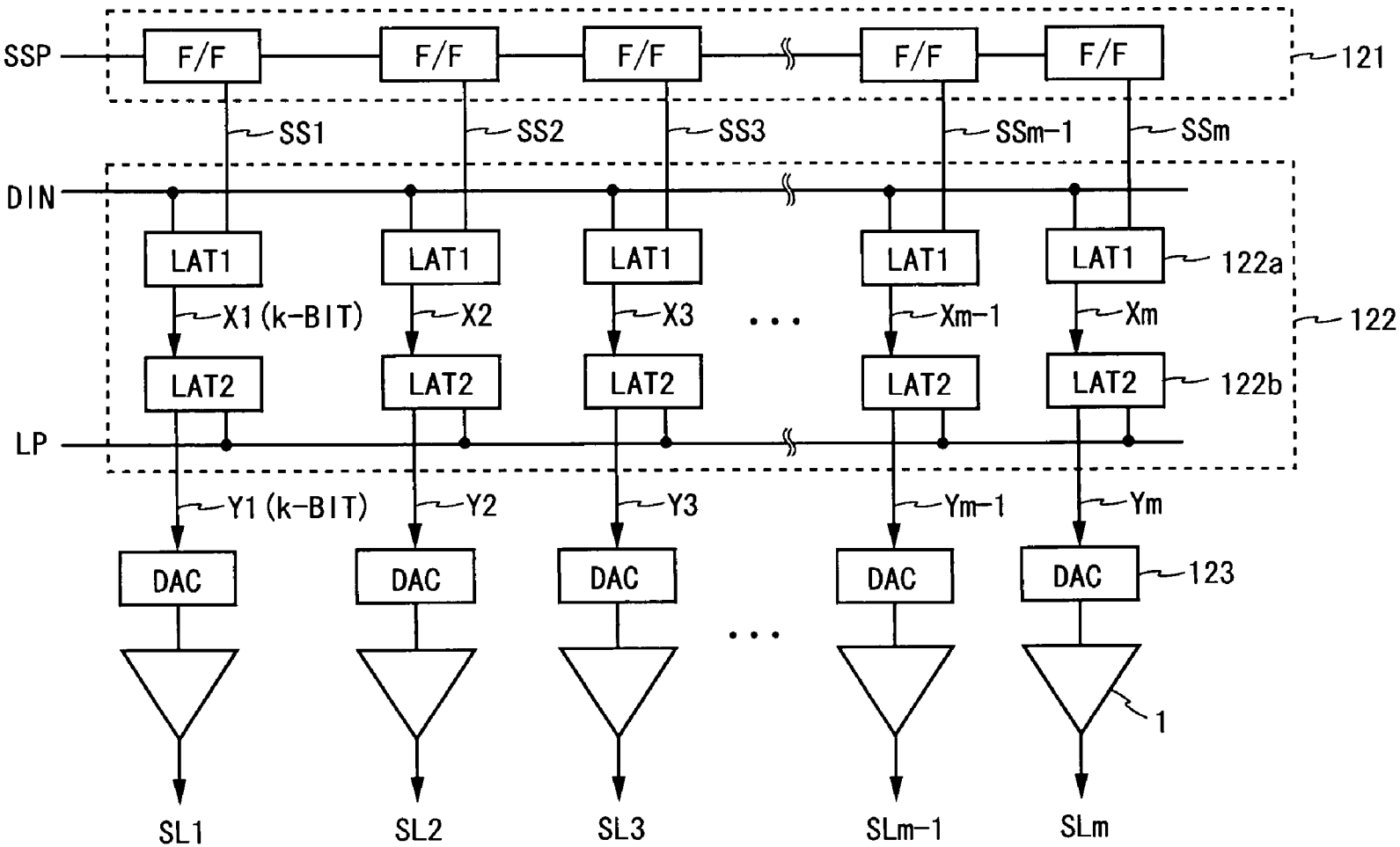
FIG. 3 is a block diagram illustrating the configuration of a data signal line drive circuit included in the liquid crystal display device shown in FIG. 2.

FIG. 3 is a block diagram illustrating a detailed configuration of the data signal line drive circuit 120. The data signal line drive circuit 120 includes an m-stage shift register 121, 2m latches 122 (which are grouped into m input-side latches 122*a* and *m* output-side latches 122*b*), m D/A converters 123, and m amplifier circuits 1, as shown in FIG. 3. The shift register 121 consists of m cascaded flip-flops. In association with each stage of the shift register 121, the k-bit input-side latch 122*a*, the k-bit output-side latch 122*b*, the D/A converter 123, and the amplifier circuit 1 are provided. Hereinafter, a circuit provided in association with the ith stage (where i is an integer from 1 to m) of the shift register is referred to as the "ith circuit".

Figure 4:
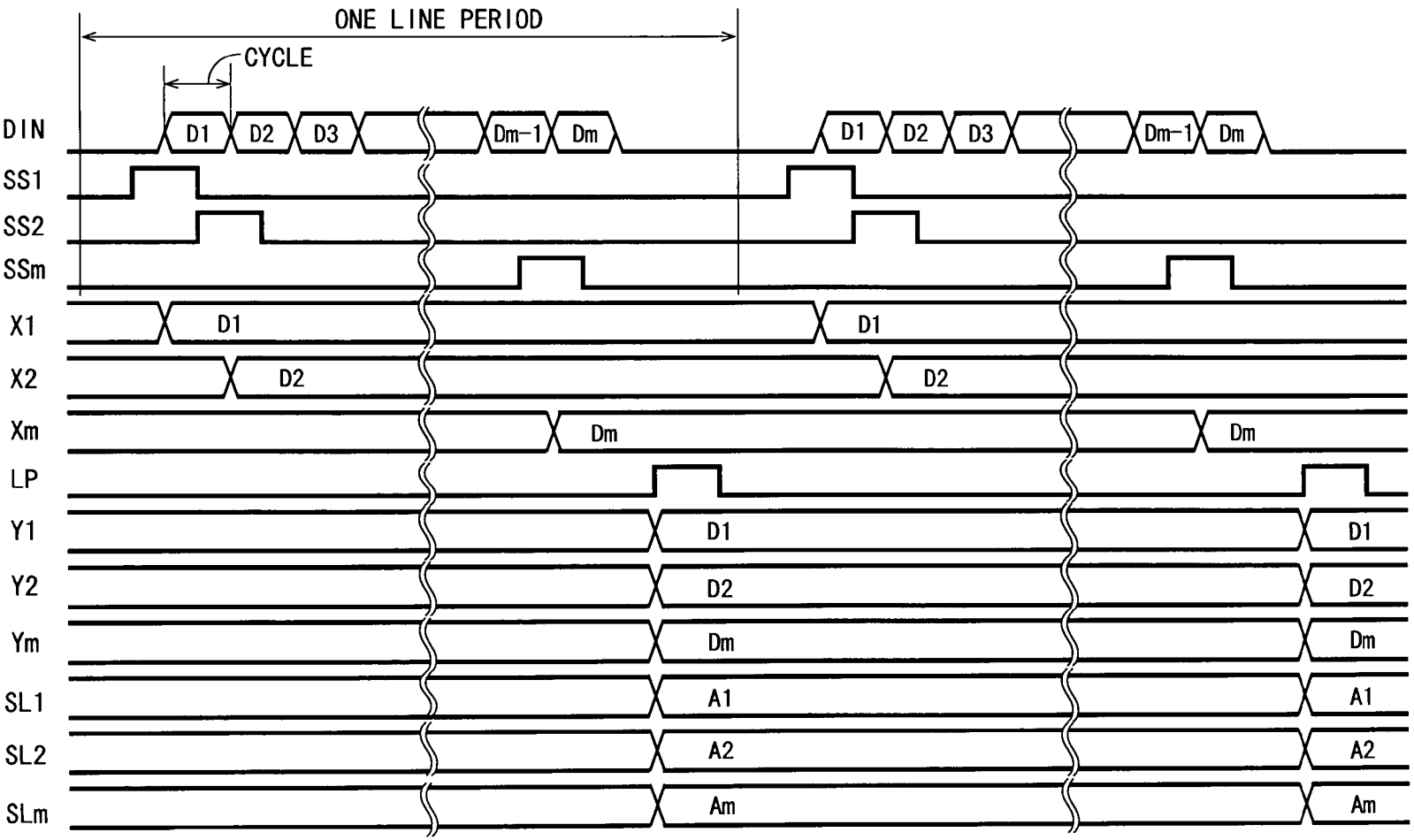
FIG. 4 is a timing chart for the data signal line drive circuit shown in FIG. 3.

FIG. 4 is a timing chart for the data signal line drive circuit 120. As shown in FIG. 4, the data signal line drive circuit 120 is supplied with the digital video signal DIN, which changes per cycle. A source start pulse SSP (omitted in FIG. 4) is brought into a predetermined level (which is assumed hereinafter to be "high level") for one cycle within one line period. The shift register 121 shifts the source start pulse SSP by one stage per cycle. Accordingly, output signals SS1 to SSm from the shift register 121 are brought into high level for one cycle in the order: SS1, SS2, . . . , SSm. The ith input-side latch 122*a* memorizes the digital video signal DIN when the output signal SSi from the shift register 121 changes from high to low level.

After m digital video signals DIN are inputted, a latch pulse LP is brought into a predetermined level (which is assumed hereinafter to be "high level") for one cycle. When the latch pulse LP changes from low to high level, the ith output-side latch 122*b* memorizes the digital video signal memorized in the ith input-side latch 122*a*. This allows the m digital video signals memorized in m input-side latches 122*a* to be collectively transferred to m output-side latches 122*b*.

The ith D/A converter 123 converts the digital video signal memorized in the ith output-side latch 122*b* into an analog video signal. The ith amplifier circuit 1 has an output terminal connected to a data signal line SLi. The ith amplifier circuit 1 amplifies an analog input signal outputted from the ith D/A converter 123 and drives the data signal line SLi based on the amplified signal.

Referring again to FIG. 1, the amplifier circuit 1 will be described in detail below. The amplifier circuit 1 includes inverters 11 to 13 serving as logical negation circuits, switches 21 to 23, capacitors 31 to 33, stop control switches 41 to 43, a feedback control switch 51, a separation switch 61, and an initial setting switch 71, as shown in FIG. 1. Among them, the switches 21 to 23, the feedback control switch 51, and the separation switch 61 are analog switches in which a P-type transistor and an N-type transistor are connected in parallel.

The inverters 11 to 13 are cascaded, and serve as amplifiers independently of each other, as will be described later. The inverter 13 includes a P-type transistor 14 and an N-type transistor 15. The P-type transistor 14 has a source terminal supplied with a high level source voltage VDD, whereas the N-type transistor 15 has a source terminal supplied with a low level source voltage VSS via the stop control switch 43. Gate terminals of the P-type transistor 14 and the N-type transistor 15 are both connected to an output terminal of the inverter 12 via the capacitor 33. This allows the gate terminals of the P-type transistor 14 and the N-type transistor 15 to be supplied with an output signal from the inverter 12. Also, drain terminals of the P-type transistor 14 and the N-type transistor 15 are connected to a common node, which serves as an output terminal of the inverter 13. Although omitted in the figure, the inverters 11 and 12 are configured similarly.

The switches 21 to 23 are provided between the input and output terminals of the inverters 11 to 13, respectively, and serve as threshold setting switches for selecting whether or not to short-circuit the input and output terminals of the inverters 11 to 13. The capacitor 31 has an electrode connected to an input terminal for the analog input signal AIN, and another electrode connected to the input terminal of the inverter 11. The capacitor 31 serves as a first-stage capacitive element provided between the input terminal for the analog input signal AIN and the input terminal of the first-stage inverter 11. The capacitor 32 has an electrode connected to the output terminal of the inverter 11, and another electrode connected to the input terminal of the inverter 12. The capacitor 33 has an electrode connected to the output terminal of the inverter 12, and another electrode connected to the input terminal of the inverter 13. Each of the capacitors 32 and 33 serves as an interstage capacitive element provided between the input terminal of the inverter 12, 13 not provided at the first stage and the output terminal of the inverter 11, 12 provided at the previous stage.

The stop control switches 41 to 43 are provided between the source terminals of the N-type transistors included in their respective inverters 11 to 13 and the low level source voltage VSS. The stop control switches 41 to 43 are controlled based on a common control signal to be turned "ON" when the amplifier circuit 1 is in operation, and "OFF" when in rest. The feedback control switch 51 is provided between the output terminal of the inverter 13 and one electrode of the capacitor 31 (the electrode being connected to the input terminal for the analog input signal AIN, which is referred to hereinafter as the "input-side electrode"), and selects whether or not to feed back an output signal from the last-stage inverter 13 to an input to the first-stage inverter 11.

The inverters 11 to 13, the switches 21 to 23, the capacitors 31 to 33, and the feedback control switch 51 constitute an amplifying portion including a plurality of cascaded amplifiers (the inverters 11 to 13), which negatively feeds back the output signal from the last-stage amplifier (the inverter 13) to the input to the first-stage amplifier (the inverter 11).

The separation switch 61 is provided between the output terminal of the inverter 13 and the signal line SL, and selects whether or not to supply an output signal from the amplifying portion (an output signal from the last-stage inverter 13) to the signal line SL. The initial setting switch 71 is provided between the signal line SL and the low level source voltage VSS, and selects whether or not to supply the low level source voltage VSS to the signal line SL.

The switches 21 to 23 are controlled based on a common control signal (hereinafter, referred to as a "switch control signal SC1"). The feedback control switch 51 and the separation switch 61 are controlled based on a common control signal (hereinafter, referred to as a "switch control signal SC2") different from the switch control signal SC1. The initial setting switch 71 is controlled based on a negation of the switch control signal SC2 (hereinafter, referred to by "SC2B"). These switches are brought into "ON" state when signals supplied to their control terminals are at high level.

Figure 5:
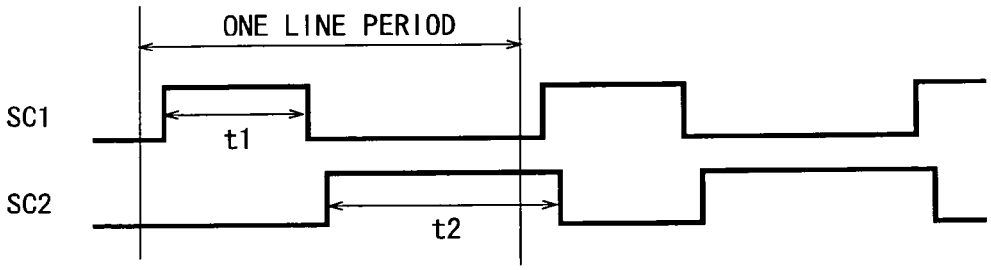
FIG. 5 is a timing chart for control signals supplied to an amplifier circuit in the data signal line drive circuit shown in FIG. 3.

FIG. 5 is a timing chart for control signals supplied to the amplifier circuit 1. Referring to FIG. 5, the operation of the amplifier circuit 1 will be described below on the assumption that the stop control switches 41 to 43 are in "ON" state. Corresponding to the line-sequential drive performed by the data signal line drive circuit 120, the amplifier circuit 1 drives the signal line SL once per line period. Therefore, the switch control signals SC1 and SC2 are each brought into high level once within one line period, as shown in FIG. 5. More specifically, within one line period, first, the switch control signal SC1 is brought into high level for a predetermined time period t1, and the switch control signal SC1 changes to low level before the switch control signal SC2 is brought into high level for a predetermined time period t2. Note that in FIG. 5, the switch control signal SC1 changes to high level before the switch control signal SC2 changes to low level, but it may change to high level after the switch control signal SC2 changes to low level.

Hereinafter, a period in which the switch control signals SC1 and SC2 are at high and low levels, respectively, is referred to as an "initial setting period", and a period in which the switch control signals SC1 and SC2 are at low and high levels, respectively, is referred to as a "writing period". In the case of the amplifier circuit 1, each of the initial setting period and the writing period occurs once within one line period.

During the initial setting period, the switches 21 to 23 and the initial setting switch 71 are brought into "ON" state, whereas the feedback control switch 51 and the separation switch 61 are brought into "OFF" state. Therefore, during the initial setting period, the signal line SL is connected to the low level source voltage VSS via the initial setting switch 71, so that the voltage on the signal line SL becomes equal to the low level source voltage VSS. In addition, the input and output terminals of the inverters 11 to 13 are short-circuited.

Figure 6:
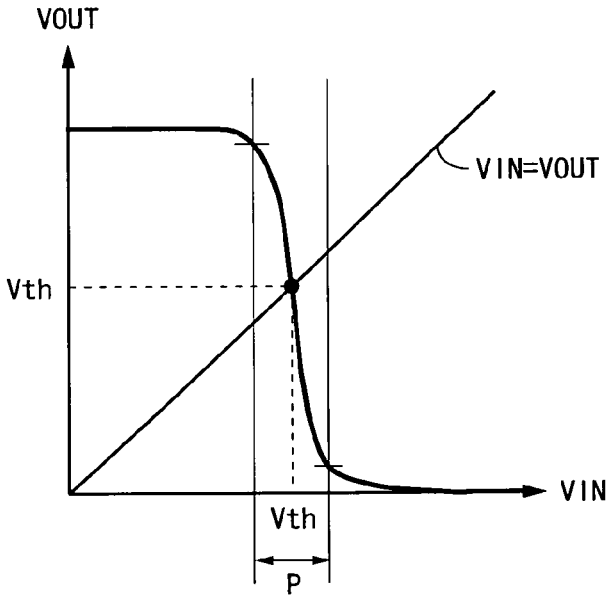
FIG. 6 is a graph showing input-output characteristics of an inverter.

When input and output voltages of an inverter are taken as VIN and VOUT, respectively, they have a relationship as shown in FIG. 6. When short-circuiting input and output terminals of the inverter having characteristics as shown in FIG. 6, the input voltage VIN and the output voltage VOUT are equalized (which voltage is referred to hereinafter as a "logic threshold voltage"). Note that in FIG. 6, the coordinate point at the intersection between the curve representing the characteristics and the straight line VIN=VOUT corresponds to a logic threshold voltage Vth.

Since the input and output terminals of the inverters 11 to 13 are short-circuited during the initial setting period, both the input and output voltages of the inverters 11 to 13 become the logic threshold voltages of the inverters. Ideally, it is preferable that the logic threshold voltages of the inverters match one another, but in fact, there are production variations, and therefore the logic threshold voltages of the inverters do not completely match one another. Accordingly, the capacitor 32 holds the difference in the logic threshold voltage between the inverters 11 and 12, and the capacitor 33 holds the difference in the logic threshold voltage between the inverters 12 and 13. In addition, the input-side electrode of the capacitor 31 is supplied with the analog input signal AIN, and therefore the capacitor 31 holds the difference between the voltage of the analog input signal AIN (hereinafter, referred to as the "input voltage Va") and the logic threshold voltage of the inverter 11.

In this manner, during the initial setting period, the voltage of the signal line SL becomes equal to the low level source voltage VSS, whereas the input voltages of the inverters 11 to 13 become equal to their respective logic threshold voltages. Thereafter, the writing period starts.

During the writing period, the switches 21 to 23 and the initial setting switch 71 are brought into "OFF" state, whereas the feedback control switch 51 and the separation switch 61 are brought into "ON" state. Therefore, during the writing period, the signal line SL is connected to the output terminal of the inverter 13 via the separation switch 61, whereas the output terminal of the inverter 13 is connected to the input-side electrode of the capacitor 31 via the feedback control switch 51.

While the feedback control switch 51 is in "ON" state, the input-side electrode of the capacitor 31 is supplied with the output voltage of the inverter 13. Therefore, when the output voltage of the inverter 13 is lower than the input voltage Va, the input-side electrode of the capacitor 31 becomes lower in voltage. Since the capacitors 31 to 33 retain predetermined potential differences, and the inverters 11 to 13 have the characteristics as shown in FIG. 6, as the input-side electrode of the capacitor 31 becomes lower in voltage, the input voltage of the inverter 11 falls; the output voltage of the inverter 11 and the input voltage of the inverter 12 rise; the output voltage of the inverter 12 and the input voltage of the inverter 13 fall; and the output voltage of the inverter 13 rises.

On the other hand, when the output voltage of the inverter 13 is higher than the input voltage Va, the input-side electrode of the capacitor 31 becomes higher in voltage. Correspondingly, the input voltage of the inverter 11 rises, the output voltage of the inverter 11 and the input voltage of the inverter 12 fall, the output voltage of the inverter 12 and the input voltage of the inverter 13 rise, and the output voltage of the inverter 13 falls. In this manner, the output voltage of the inverter 13 rises when it is lower than the input voltage Va, and falls when higher than the input voltage Va, with the result that it ultimately becomes equal to the input voltage Va.

Also, when the input voltage VIN of the inverter is close to the logic threshold voltage Vth (when it is within the range P), if the input voltage VIN changes even slightly, the output voltage VOUT changes significantly, as shown in FIG. 6. Accordingly, when the input voltage VIN is close to the logic threshold voltage Vth, the inverter serves as an amplifier.

In the case of the amplifier circuit 1, the input voltages of the inverters 11 to 13 are set at the logic threshold voltage in the initial setting period. Therefore, during the writing period, the inverters 11 to 13 all serve as amplifiers, and when the input voltage of the inverter 11 changes, the output voltage of the inverter 13 changes significantly. Thus, by cascading the inverters 11 to 13 serving as amplifiers, it becomes possible to amplify the analog input signal AIN with a high amplification factor.

The last-stage inverter 13 included in the amplifier circuit 1 has the following features. While typical inverters consist of P- and N-type transistors having the same current drive capability, the last-stage inverter 13 consists of the P-type transistor 14 and the N-type transistor 15 having different current drive capabilities. More specifically, corresponding to the fact that the initial setting switch 71 is provided between the signal line SL and the low level source voltage VSS, a transistor having a lower current drive capability than the P-type transistor 14 is used as the N-type transistor 15 having a source terminal supplied with the low level source voltage VSS. To this end, a transistor sized smaller than the P-type transistor 14 may be used as the N-type transistor 15. Concretely, the ratio of channel width Wn to channel length Ln (Wn/Ln) of the N-type transistor 15 may be set smaller than the ratio of channel width Wp to channel length Lp (Wp/Lp) of the P-type transistor 14.

Effects of the amplifier circuit 1 according to the present embodiment will be described below. In the amplifier circuit 1, the separation switch 61 and the initial setting switch 71 are alternately brought into "ON" state, so that the voltage on the signal line SL becomes equal to the low level source voltage VSS during the initial setting period, and with the input voltage Va during the writing period. At the beginning of the writing period, the output voltage of the inverter 13 is lower than the input voltage Va, and therefore the output voltage of the inverter 13 (i.e., the voltage on the signal line SL) rises. The reason why the voltage on the signal line SL rises is that current flows from the high level source voltage VDD through the P-type transistor 14 to the signal line SL.

It is the P-type transistor 14 included in the last-stage inverter 13, rather than the N-type transistor 15, that changes the voltage on the signal line SL at the beginning of the writing period as described above. Accordingly, unlike in the case of typical inverters, even if the current drive capability of the N-type transistor 15 is set to be sufficiently lower than that of the P-type transistor 14, the rate of change (slew rate) of the voltage on the signal line SL does not change at the beginning of the writing period.

Figure 7:
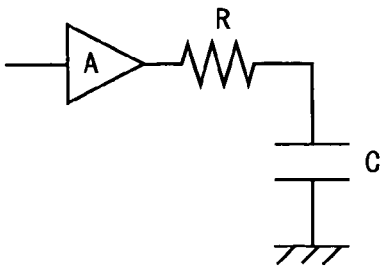
FIG. 7 is a diagram illustrating an equivalent circuit of a single inverter.

On the other hand, by reducing the current drive capability of the N-type transistor 15, resistance as viewed from the output side increases, thereby enhancing operational stability of the amplifier circuit 1. The reason for this will be described below with reference to FIGS. 7 to 9. A single inverter can be represented by an equivalent circuit as shown in FIG. 7. In FIG. 7, A denotes an amplification factor for a DC component of the inverter, R denotes a resistance of the inverter, C denotes a capacitance value of the output stage of the inverter. When the amplification factors for the DC components, the resistances, and the output stage capacitance values of the inverters 11 to 13 are respectively taken as A1 to A3, R1 to R3, and C1 to C3, an open-loop gain Ao of the amplifying portion including the inverters 11 to 13 can be given by the following equation (1). Note that in the following equation (1), ω is a signal frequency.

$$Ao=A1/(1+j\omega R1C1)\times A2/(1+j\omega R2C2)\times A3/(1+j\omega R3C3) \quad (1)$$

Figure 8:
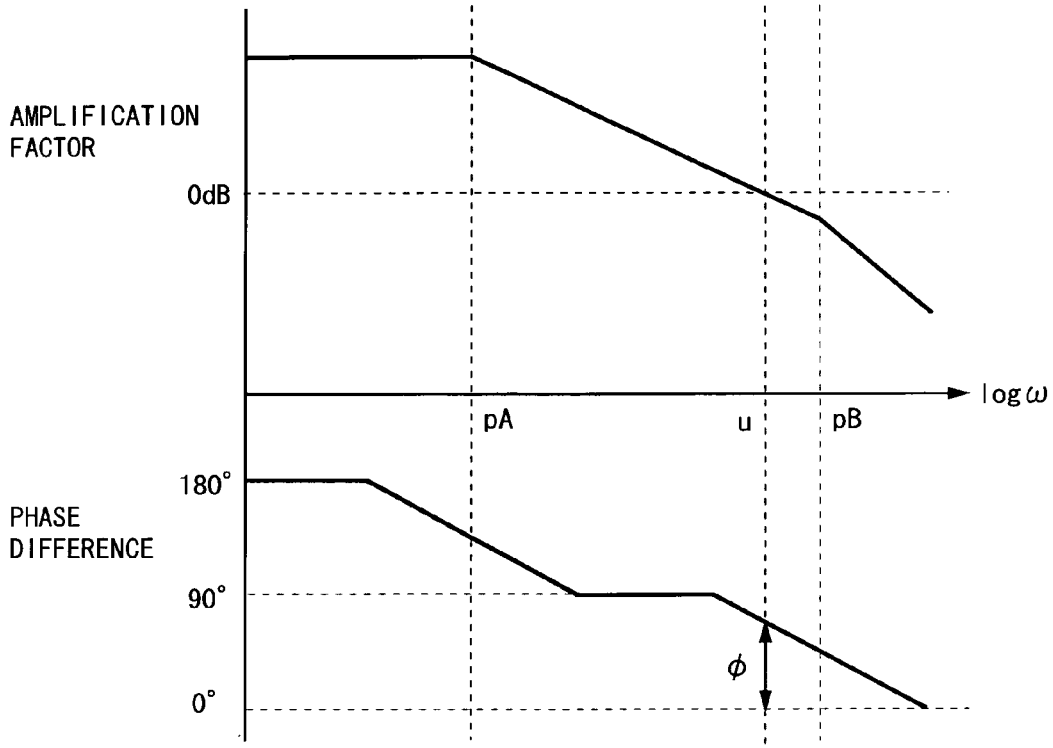
FIG. 8 is a graph showing frequency characteristics of an amplifier circuit including a plurality of inverters.

In the case of cascading a plurality of inverters to configure an amplifying portion, the amplifying portion has frequency characteristics as shown in FIG. 8. Specifically, the amplification factor is represented by a broken line deflected at pole frequencies (in FIG. 8, pA and pB), and the phase difference changes by 90° centering about the pole frequencies. In this case, the minimum from among the values 1/R1C1, 1/R2C2, and 1/R3C3 is the first pole frequency pA, and the second minimum value is the second pole frequency pB. To prevent oscillation from occurring when performing negative feedback in the amplifying portion having the characteristics shown in FIG. 8, the phase difference ϕ at frequency u where the amplification factor is 1 (0 dB) needs to be about 60° or more.

In the case of using the amplifier circuit 1 to drive a data signal line in a liquid crystal display device, the capacitance value of the data signal line is sufficiently greater than capacitance values of wiring conductors in the amplifier circuit 1, and therefore the capacitance value C3 of the output stage of the last-stage inverter 13 becomes sufficiently greater than the capacitance values C1 and C2 of the other inverters 11 and 12. Accordingly, 1/R3C3 is the minimum from among the values 1/R1C1, 1/R2C2, and 1/R3C3, and is set as the first pole frequency pA.

As described above, in the case of the last-stage inverter 13, unlike in the case of typical inverters, the N-type transistor 15 has a lower current drive capability than the P-type transistor 14. Accordingly, the inverter 13 has a higher resistance R3 than typical inverters. Therefore, in the case of using the inverter 13 for an amplifying portion, the first pole frequency pA is lower than those of typical inverters.

Figure 9:
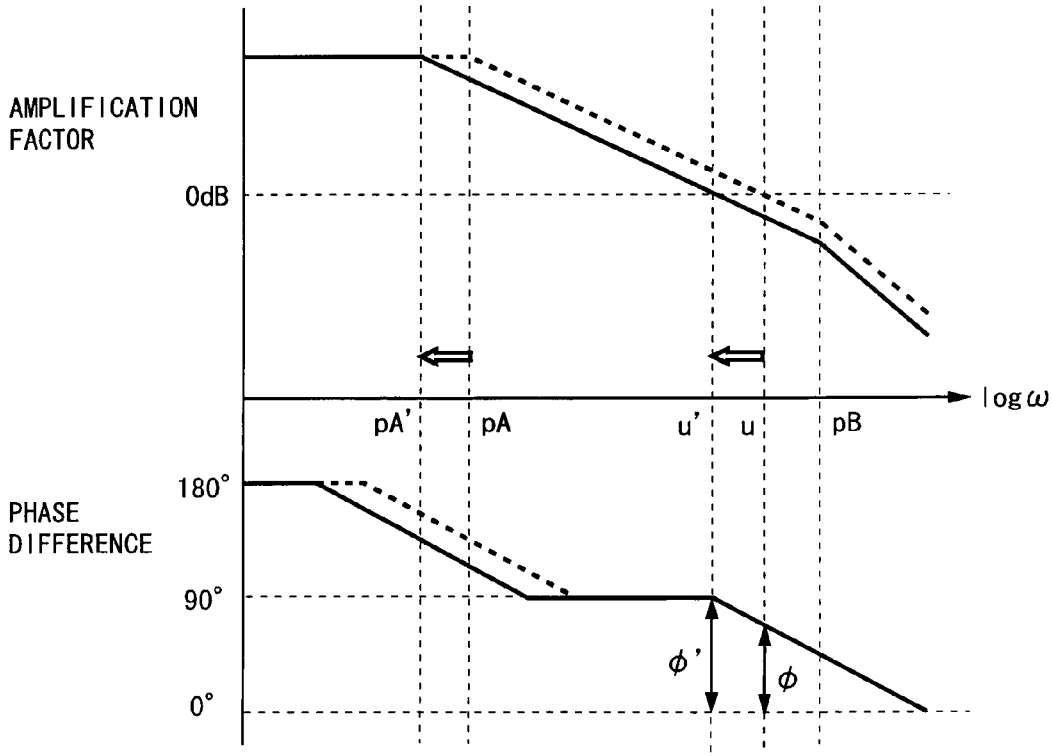
FIG. 9 is a graph showing frequency characteristics of the amplifier circuit shown in FIG. 1.

FIG. 9 is a graph showing frequency characteristics of the amplifier circuit 1. In FIG. 9, the frequency characteristics of the amplifier circuit 1 are indicated by solid lines, and frequency characteristics of an amplifier circuit using typical inverters are indicated by dashed lines. The amplifier circuit 1 has a lower first pole frequency (pA'<pA), and therefore the broken line representing the amplification factor shifts toward a lower frequency. Correspondingly, the frequency where the amplification factor is 1 decreases from u to u', and the phase difference at the frequency where the amplification factor is 1 increases from ϕ to ϕ'. As the phase difference increases, the operational stability of the amplifier circuit 1 is enhanced.

Also, by reducing the current drive capability of the N-type transistor 15, the resistance as viewed from the output side increases, so that power consumed by the inverter 13 decreases, resulting in decreased power consumption of the entire amplifier circuit 1.

Note that in the case of reducing the current drive capability of the N-type transistor 15, if it is acceptable that the operation stability of the amplifier circuit 1 remains the same level, two transistors included in the inverter 12 at the second stage from last may be reduced in size, thereby increasing the resistance of the inverter 12 and reducing the second pole frequency. As a result, it becomes possible to maintain the operational stability of the amplifier circuit 1 at the same level, while reducing the power consumption of the inverter 12.

As described above, in the case of the amplifier circuit 1 according to the present embodiment, when alternately rendering the initial setting switch 71 and the separation switch 61 conductive, the voltage on the signal line SL varies for a while after the separation switch 61 is rendered conductive, due to current flowing through the P-type transistor 14 included in the last-stage inverter 13. Accordingly, the rate of change of the voltage on the signal line SL does not change by reducing the current drive capability of the N-type transistor 15. On the other hand, by reducing the current drive capability of the N-type transistor 15, the output resistance of the last-stage inverter 13 increases, so that in accordance with the frequency characteristics of the amplifier circuit 1, the phase margin increases, whereas the power consumption of the amplifier circuit 1 decreases. As such, it is possible to enhance the stability and the low-power-consumption capability of the amplifier circuit, while maintaining the slew rate.

Second Embodiment

Figure 10:
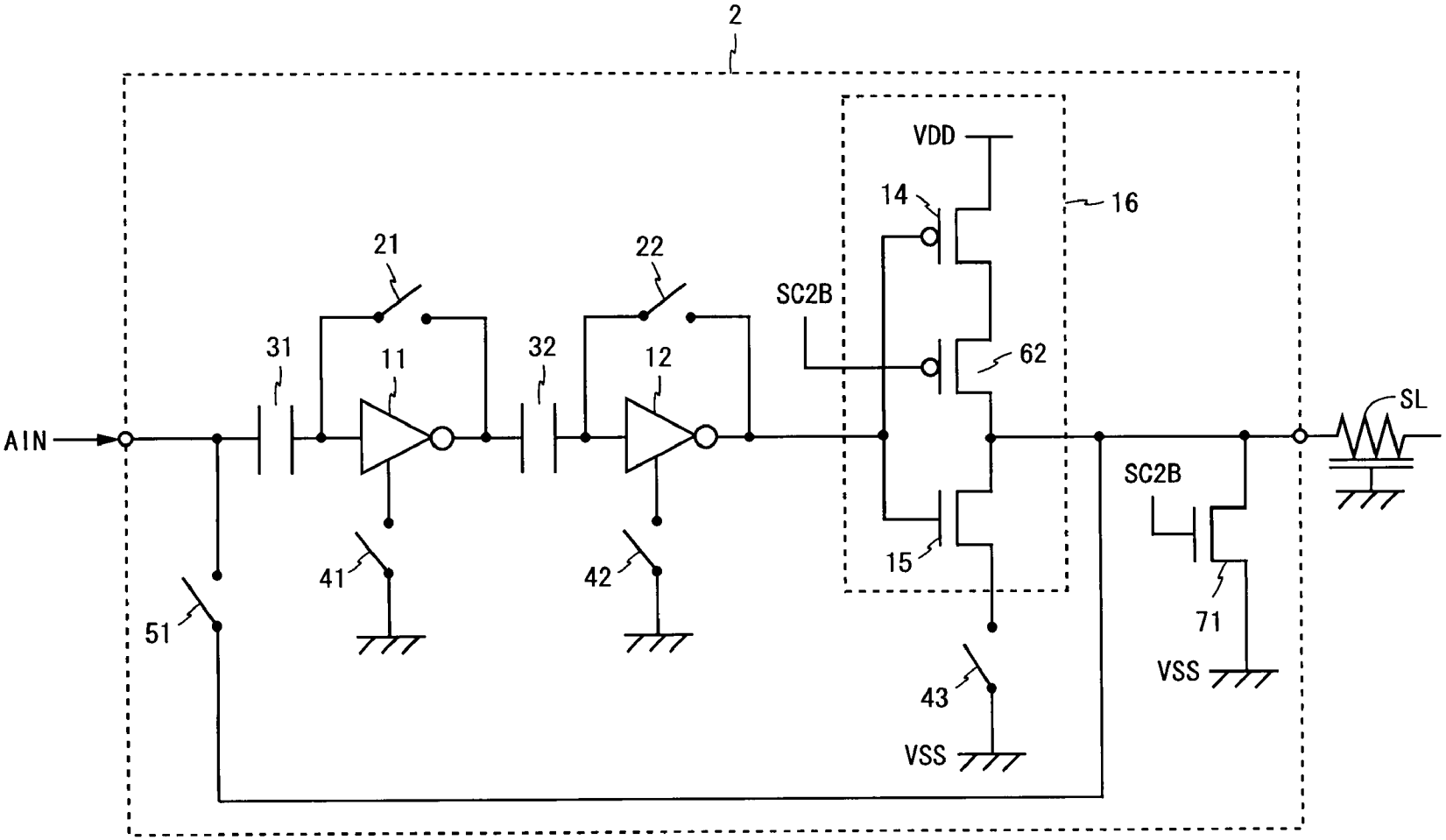
FIG. 10 is a circuit diagram for an amplifier circuit according to a second embodiment of the present invention.

FIG. 10 is a circuit diagram for an amplifier circuit according to a second embodiment of the present invention. The amplifier circuit 2 shown in FIG. 10 is obtained by providing the amplifier circuit 1 according to the first embodiment (FIG. 1) with an inverter 16 (including a separation switch 62) in place of the inverter 13, and omitting the separation switch 61 and the capacitor 33. As with the amplifier circuit 1, the amplifier circuit 2 can be used for driving a data signal line in a liquid crystal display device (see FIGS. 2 and 3). In the present embodiment, the same elements as those in the first embodiment are denoted by the same reference characters, and any descriptions thereof will be omitted.

In the amplifier circuit 2, the switches 21 and 22 serving as threshold setting switches are respectively provided in associated with the inverters 11 and 12 not provided at the last stage. In addition, the capacitor 32 serving as an interstage capacitive element is provided between the input terminal of the inverter 12 not provided either at the first or last stage and the output terminal of the inverter 11 at the previous stage.

The amplifier circuit 2 is used in the case where a substantially desired amplification factor can be achieved with the two inverters 11 and 12. In this case, the last-stage inverter 16 is not required to have a significantly high amplification factor. Therefore, even when no capacitor is provided between the inverters 12 and 16 so that the logic threshold voltage of the inverter 12 is supplied directly to the input terminal of the inverter 16 during the initial setting period, the inverter 16 is able to amplify an input signal to a required degree. In such a case where a substantially desired amplification factor can be achieved with the two inverters 11 and 12, by not providing the threshold setting switch and the interstage capacitive element in association with the last-stage inverter 16, it becomes possible to reduce the circuit complexity of the amplifier circuit 2 by a corresponding degree.

In addition, the separation switch 62 is made up of a single transistor, and is provided in the inverter 16. Concretely, the separation switch 62 is made up of a single P-type transistor having a source terminal connected to the drain terminal of the P-type transistor 14 included in the inverter 16, and a drain terminal connected to the drain terminal of the N-type transistor 15 included in the inverter 16. The separation switch 62 has a gate terminal supplied with a negation (SC2B) of the switch control signal SC2.

During the initial setting period, the switch control signal SC2 is brought into low level, and therefore the separation switch 62 is brought into "OFF" state. At this time, the initial setting switch 71 is in "ON" state, and therefore whether the N-type transistor 15 included in the inverter 16 is in "ON" or "OFF" state, the voltage on the signal line SL becomes equal to the low level source voltage VSS. During the writing period, the switch control signal SC2 is brought into high level, and therefore the separation switch 62 is brought into "ON" state. Accordingly, as in the first embodiment, at the beginning of the writing period, current flows from the high level source voltage VDD through the P-type transistor 14 to the signal line SL, thereby increasing the voltage on the signal line SL.

In this manner, even when the separation switch 62 is used in place of the separation switch 61, it is possible to select whether or not to supply an output signal from the amplifying portion to the signal line SL. In addition, by using the separation switch 62 made up of a single transistor, it becomes possible to reduce the circuit complexity of the amplifier circuit 2.

Also, in the amplifier circuit 2, the P- and N-type transistors included in the inverter 12 at the second stage from last can be configured in the same manner as used for the last-stage inverter 16, such that the N-type transistor has a lower current drive capability than the P-type transistor. As a result, it becomes possible to increase the logic threshold voltage of the inverter 12, thereby preventing the amplification factor of the inverter 16 from decreasing excessively.

Figure 11:
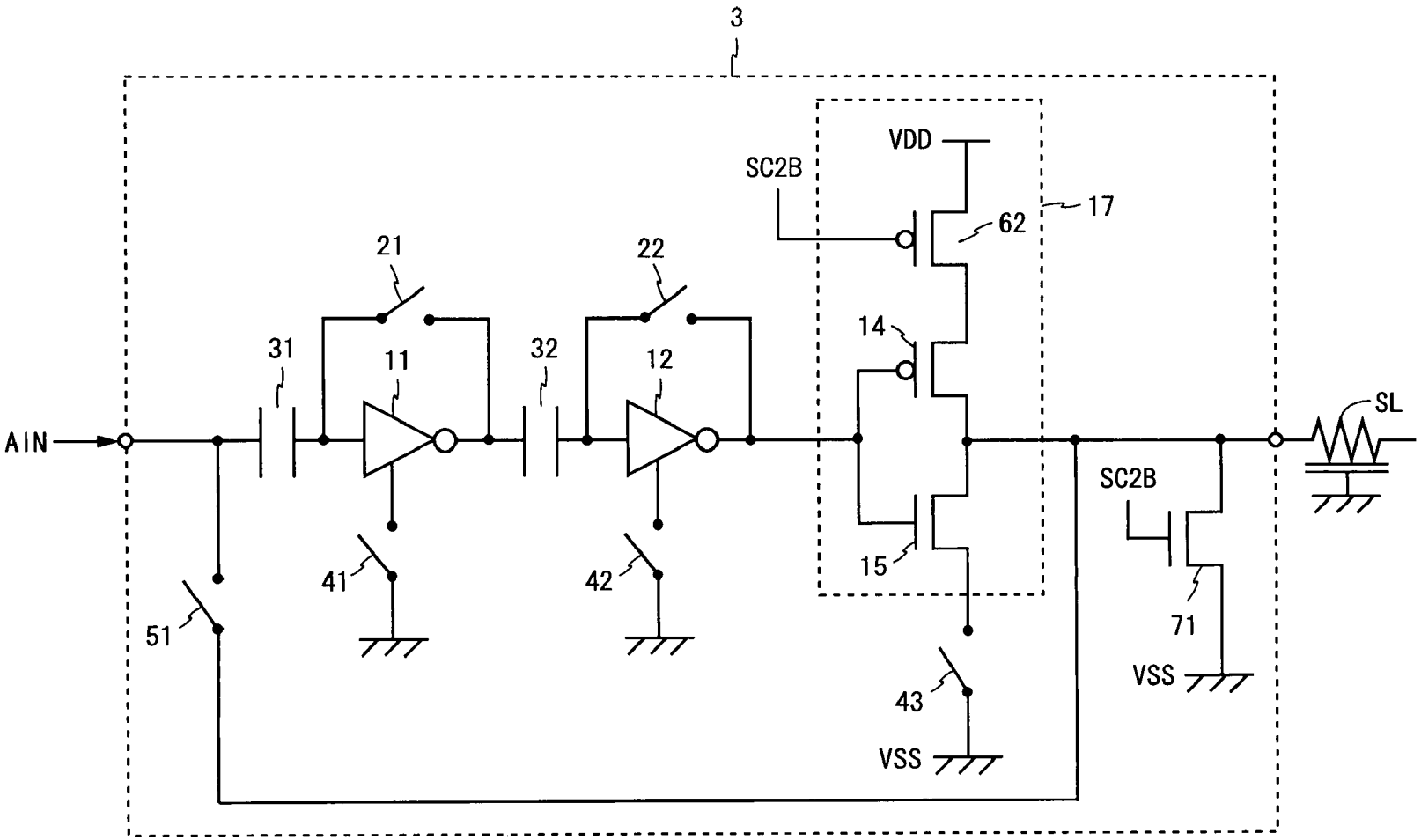
FIG. 11 is a circuit diagram for an amplifier circuit according to a variant of the second embodiment of the present invention.

Note that the following variant can be configured for the amplifier circuit 2 according to the present embodiment. An amplifier circuit 3 shown in FIG. 11 is obtained by modifying the amplifier circuit 2 such that the P-type transistor 14 and the separation switch 62 are connected in reverse order within an inverter 17. The separation switch 62 is made up of a single P-type transistor having a source terminal supplied with the high level source voltage VDD and a drain terminal connected to the source terminal of the P-type transistor 14. The separation switch 62 has a gate terminal supplied with a negation (SC2B) of the switch control signal SC2. The amplifier circuit 3 thus configured operates in a similar manner to the amplifier circuit 2, and achieves similar effects to those achieved by the amplifier circuit 2.

Third Embodiment

Figure 12:
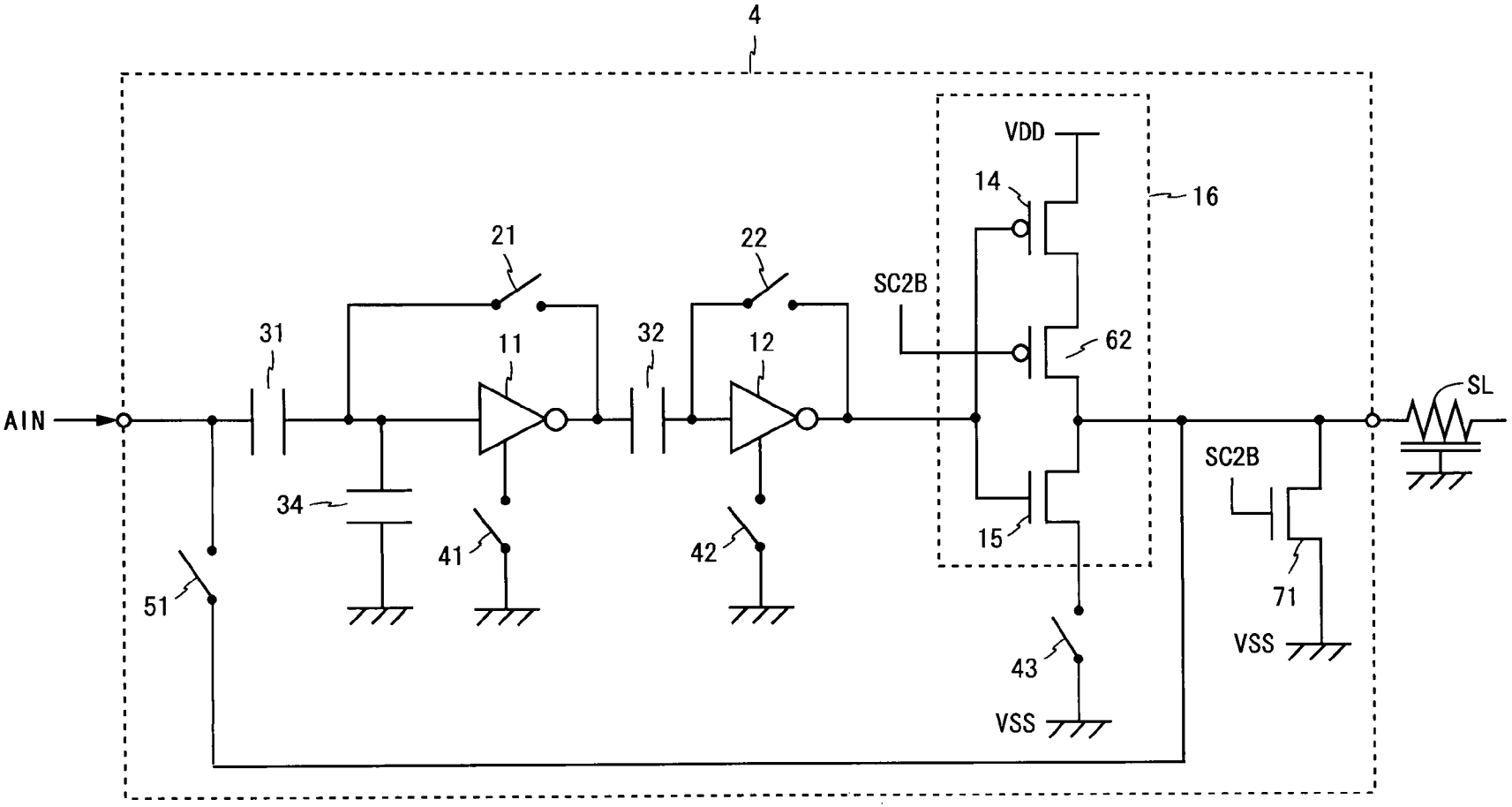
FIG. 12 is a circuit diagram for an amplifier circuit according to a third embodiment of the present invention.

FIG. 12 is a circuit diagram for an amplifier circuit according to a third embodiment of the present invention. The amplifier circuit 4 shown in FIG. 12 is obtained by adding a capacitor 34 to the amplifier circuit 2 according to the second embodiment (FIG. 10). As with the amplifier circuit 1, the amplifier circuit 4 can be used for driving a data signal line in a liquid crystal display device (see FIGS. 2 and 3). In the present embodiment, the same elements as those in the first or second embodiment are denoted by the same reference characters, and any descriptions thereof will be omitted.

The capacitor 34 has an electrode connected to the input terminal of the inverter 11, and another electrode supplied with the low level source voltage VSS. The capacitor 34 serves as an input capacitive element having an electrode connected to the input terminal of the first-stage inverter 11, and another electrode supplied with a constant voltage. The capacitor 34 has a capacitance value not allowing the switch 21 to be rendered conductive when the feedback control switch 51 is rendered conductive, provided that the input voltage Va is within a predetermined range (between minimum and maximum values).

In the case of the amplifier circuit 2 according to the second embodiment, which is not provided with the capacitor 34, when it is brought into writing state, the input voltage of the inverter 11 might decrease from the logic threshold voltage by up to (the maximum value of the input voltage Va—the low level source voltage VSS). As a result, the switch 21 might be brought into "ON" state, so that charge accumulated in the capacitor 31 might flow through the switch 21, resulting in an amplification error.

Therefore, in the case where such an amplification error might occur, the capacitor 34 having a predetermined capacitance value may be provided at the input terminal of the first-stage inverter 11, as in the amplifier circuit 4. Providing the capacitor 34 makes it possible to allow the input voltage of the inverter 11 to only change to such a slight extent as not to render the switch 21 conductive even if the voltage of the input-side electrode of the capacitor 31 changes by the greatest amount. Thus, the amplifier circuit 4 according to the present embodiment makes it possible to prevent the switch 21 from bringing into "ON" state during the writing state, thereby preventing any amplification error.

Note that in order to prevent the aforementioned amplification error, the logic threshold voltage of the first-stage inverter 11 may be increased. Concretely, the inverter 11 may have a logic threshold voltage not allowing the switch 21 to be rendered conductive when the feedback control switch 51 is rendered conductive, provided that the input voltage Va is within a predetermined range. Using such an inverter 11 also makes it possible to prevent any amplification error.

Figure 13:
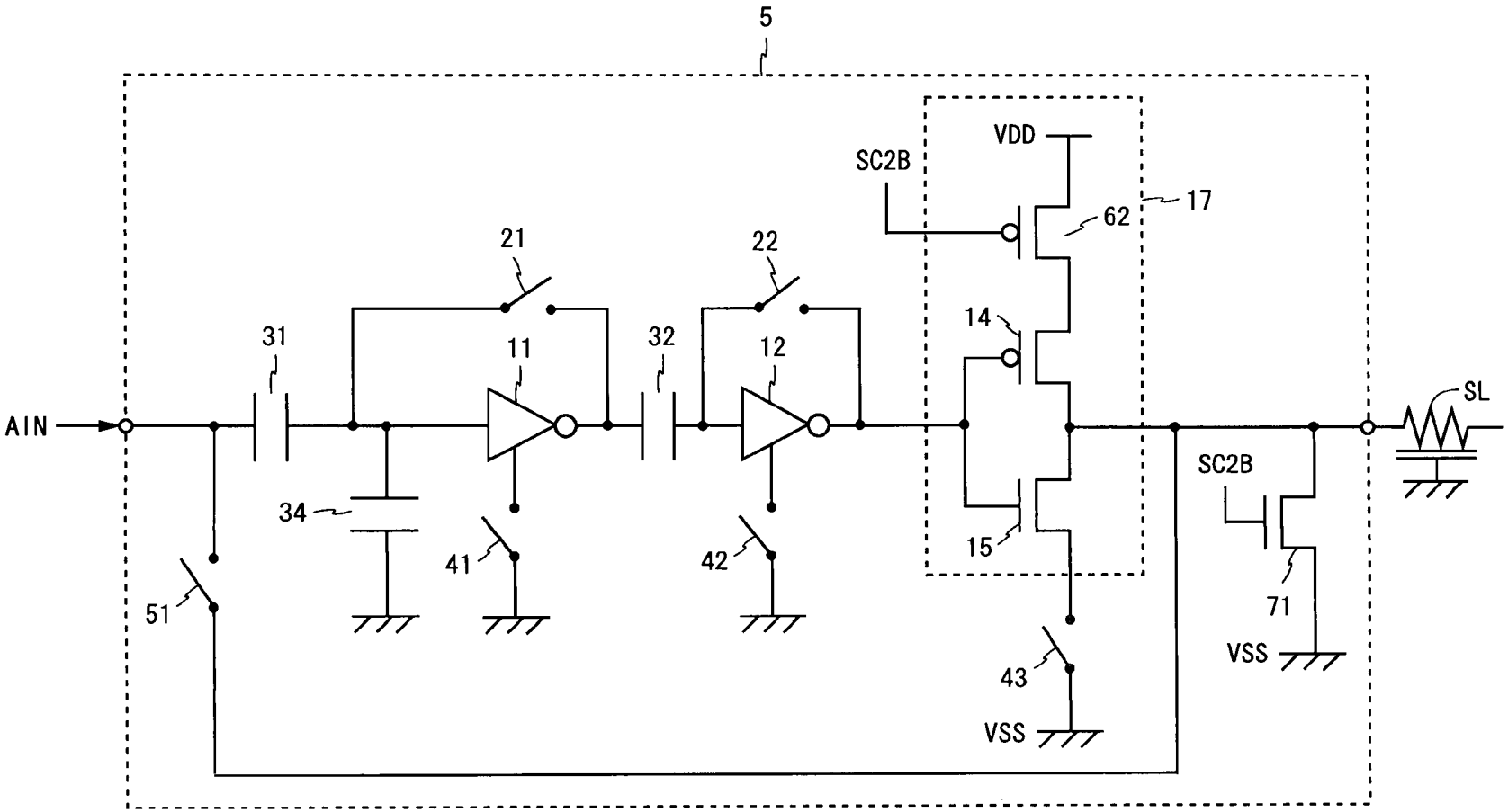
FIG. 13 is a circuit diagram for an amplifier circuit according to a variant of the third embodiment of the present invention.

In addition, a variant similar to that of the second embodiment can be configured for the amplifier circuit 4 according to the present embodiment (see FIG. 13). An amplifier circuit 5 shown in FIG. 13 operates in a similar manner to the amplifier circuit 4, and achieves similar effects to those achieved by the amplifier circuit 4.

Fourth Embodiment

Figure 14:
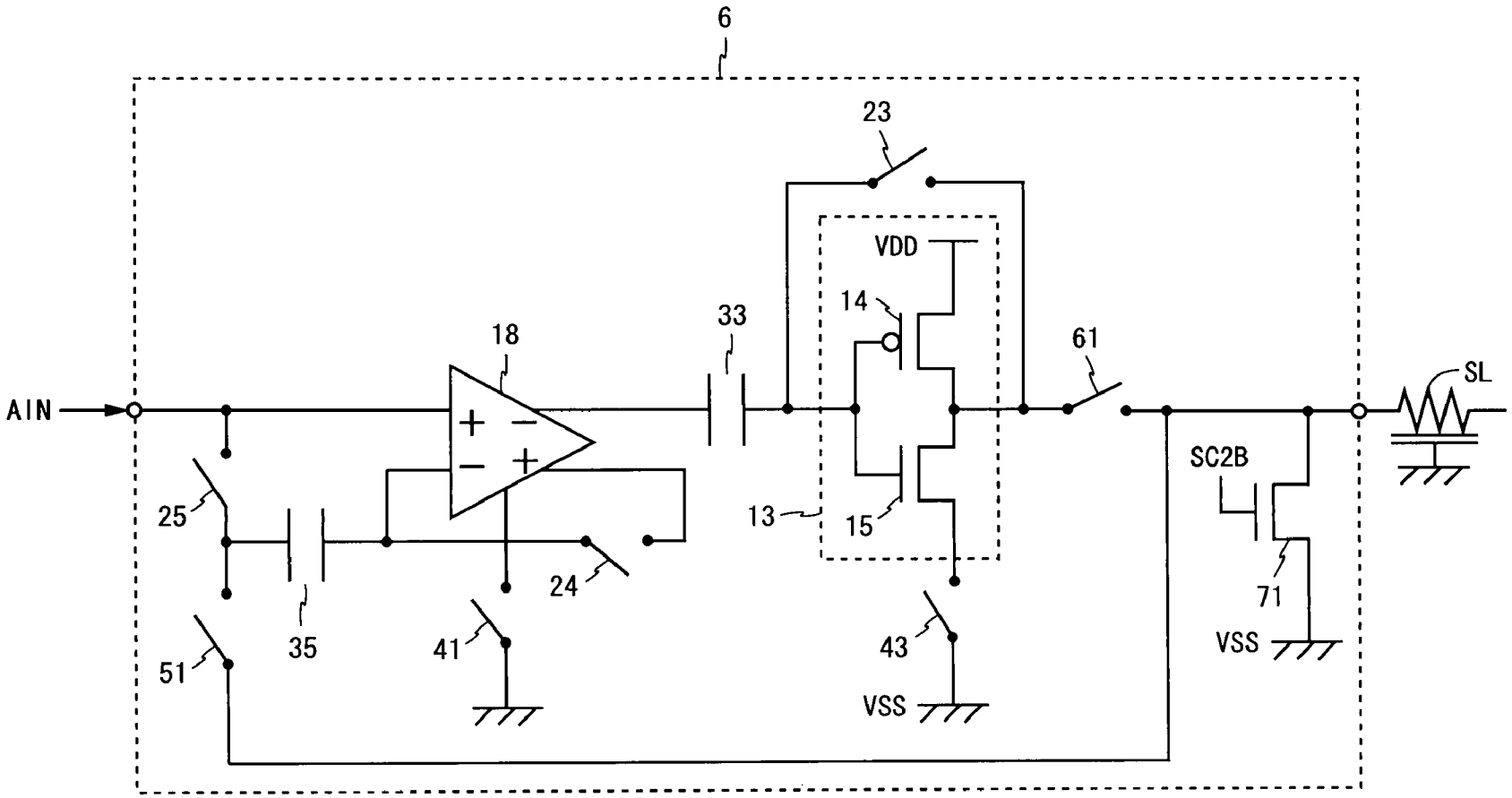
FIG. 14 is a circuit diagram for an amplifier circuit according to a fourth embodiment of the present invention.

FIG. 14 is a circuit diagram for an amplifier circuit according to a fourth embodiment of the present invention. The amplifier circuit 6 shown in FIG. 14 is obtained by providing the amplifier circuit 1 according to the first embodiment (FIG. 1) with a differential amplifier 18, switches 24, 25, and a capacitor 35, in place of the inverters 11 and 12, the switches 21 and 22, and the capacitors 31 and 32, and omitting the stop control switch 42. As with the amplifier circuit 1, the amplifier circuit 6 can be used for driving a data signal line in a liquid crystal display device (see FIGS. 2 and 3). In the present embodiment, the same elements as those in the first embodiment are denoted by the same reference characters, and any descriptions thereof will be omitted.

As shown in FIG. 14, the differential amplifier 18 has a positive-side input terminal connected to the input terminal for the analog input signal AIN. The differential amplifier 18 has a negative-side input terminal connected to the input terminal for the analog input signal AIN via the capacitor 35 and the switch 25. The differential amplifier 18 has an inverted output terminal connected to one electrode of the capacitor 33. The differential amplifier 18 has a non-inverted output terminal connected to the negative-side input terminal of the differential amplifier 18 via the switch 24. The stop control switch 41 is provided between a source terminal of an N-type transistor included in the differential amplifier 18 and the low level source voltage VSS.

The capacitor 35 serves as a first-stage capacitive element having an electrode connected to the negative-side input terminal of the differential amplifier 18. The switch 24 serves as an amplifier control switch for selecting whether or not to short-circuit the non-inverted output terminal and the negative-side input terminal of the differential amplifier 18. The switch 25 serves as an input control switch for selecting whether or not to provide the analog input signal AIN to an electrode of the capacitor 35 (the electrode being connected to the input terminal for the analog input signal AIN via the switch 25; hereinafter, referred to as the "input-side electrode").

The differential amplifier 18 inverts and amplifies the difference between the input voltage Va and the output voltage of the inverter 13. A signal outputted from the inverted output terminal of the differential amplifier 18 is supplied to one electrode of the capacitor 33. The inverter 13, the differential amplifier 18, the switches 23 to 25, the capacitors 33 and 35, and the feedback control switch 51 constitute an amplifying portion including a plurality of cascaded amplifiers (the differential amplifier 18 and the inverter 13), which negatively feeds back the output signal from the last-stage amplifier (the inverter 13) to an input to the first-stage amplifier (the differential amplifier 18).

The switches 23 to 25 are controlled based on the switch control signal SC1. The feedback control switch 51 and the separation switch 61 are controlled based on the switch control signal SC2. The initial setting switch 71 is controlled based on the negation SC2B of the switch control signal SC2. These switches are brought into "ON" state when the signals supplied to the control terminals are brought into high level. The switch control signals SC1 and SC2 change as in the first embodiment (see FIG. 5).

During the initial setting period (in which the switch control signal SC1 is at high level, and the switch control signal SC2 is at low level), the switches 23 to 25 and the initial setting switch 71 are brought into "ON" state, whereas the feedback control switch 51 and the separation switch 61 are brought into "OFF" state. Therefore, during the initial setting period, the signal line SL is connected to the low level source voltage VSS via the initial setting switch 71, so that the voltage on the signal line SL becomes equal to the low level source voltage VSS.

In addition, during the initial setting period, the input and output terminals of the inverter 13 are short-circuited via the switch 23, and therefore both the input and output voltages of the inverter 13 become equal to the logic threshold voltage of the inverter 13. Moreover, the non-inverted output terminal and the negative-side input terminal of the differential amplifier 18 are short-circuited via the switch 24, and therefore the non-inverted output voltage and the negative-side input voltage of the differential amplifier 18 are equalized (hereinafter, which voltage is referred to as an initial voltage Vi; the initial voltage Vi being substantially equal to the input voltage Va). Furthermore, the input-side electrode of the capacitor 35 is connected to the input terminal for the analog input signal AIN via the switch 25, and therefore the input voltage Va is applied to the input-side electrode of the capacitor 35. As a result, the capacitor 33 holds the difference between the logic threshold voltage of the inverter 13 and the inverted output voltage of the differential amplifier 18 with the input voltage Va provided to the positive-side input terminal and the initial voltage Vi provided to the negative-side input terminal, whereas the capacitor 35 holds the difference between the input voltage Va and the initial voltage Vi.

During the writing period (in which the switch control signal SC1 is at low level, and the switch control signal SC2 is at high level), the feedback control switch 51 and the separation switch 61 are brought into "ON" state, whereas the switches 23 to 25 and the initial setting switch 71 are brought into "OFF" state. Accordingly, during the writing period, the signal line SL is connected to the high level source voltage VDD via the P-type transistor 14 and the separation switch 61 or connected to the low level source voltage VSS via the N-type transistor 15 and the separation switch 61, depending on the output voltage from the differential amplifier 18.

When the output voltage of the inverter 13 is lower than the input voltage Va, the negative-side input voltage of the differential amplifier 18 becomes lower than the initial voltage Vi, so that the inverted output voltage of the differential amplifier 18 falls, and the output voltage of the inverter 13 rises. On the other hand, when the output voltage of the inverter 13 is higher than the input voltage Va, the negative-side input voltage of the differential amplifier 18 becomes higher than the initial voltage Vi, so that the inverted output voltage of the differential amplifier 18 rises, and the output voltage of the inverter 13 falls. In this manner, the output voltage of the inverter 13 rises when it is lower than the input voltage Va, and falls when higher than the input voltage Va, with the result that it ultimately becomes equal to the input voltage Va. Thus, the amplifying portion having the differential amplifier 18 and the inverter 13 cascaded operates in a similar manner to the amplifying portion having three inverters cascaded.

Therefore, as with the amplifier circuit 1 according to the first embodiment, the amplifier circuit 6 according to the present embodiment makes it possible to enhance the stability and the low-power-consumption capability of the amplifier circuit, while maintaining the slew rate.

Figure 15:
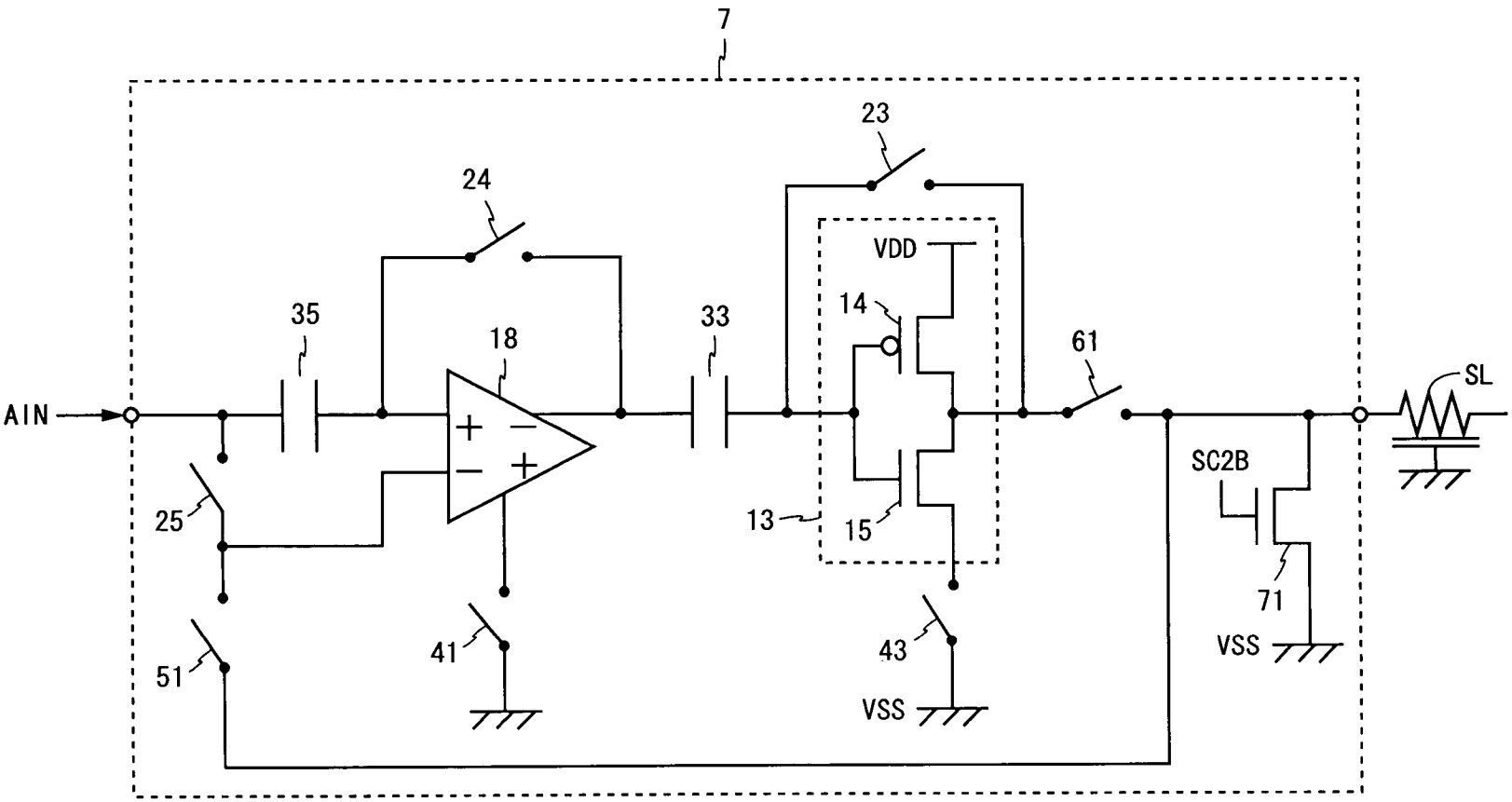
FIG. 15 is a circuit diagram for an amplifier circuit according to a variant of the fourth embodiment of the present invention.

Note that the following variant can be configured for the amplifier circuit 6 according to the present embodiment. An amplifier circuit 7 shown in FIG. 15 has the switch 24 and the capacitor 35 disposed differently from where they are in the amplifier circuit 6. The difference between the amplifier circuit 7 and the amplifier circuit 6 will be described below.

In the case of the amplifier circuit 7, the positive-side input terminal of the differential amplifier 18 is connected to the input terminal for the analog input signal AIN via the capacitor 35. The negative-side input terminal of the differential amplifier 18 is connected to the input terminal for the analog input signal AIN via the switch 25. The inverted output terminal of the differential amplifier 18 is connected to one electrode of the capacitor 33, and also connected to the positive-side input terminal of the differential amplifier 18 via the switch 24.

The capacitor 35 serves as a first-stage capacitive element having an electrode connected to the positive-side input terminal of the differential amplifier 18, and another electrode provided with the analog input signal AIN. The switch 24 serves as an amplifier control switch for selecting whether or not to short-circuit the positive-side input terminal and the inverted output terminal of the differential amplifier 18. The switch 25 serves as an input control switch for selecting whether or not to provide the analog input signal AIN to the negative-side input terminal of the differential amplifier 18.

During the initial setting period, the inverted output terminal and the positive-side input terminal of the differential amplifier 18 are short-circuited via the switch 24, and therefore the inverted output voltage and the positive-side input voltage of the differential amplifier 18 become equal to the initial voltage Vi substantially equal to the input voltage Va. In addition, the input voltage Va is applied to the input-side electrode of the capacitor 35 (the electrode being connected to the input terminal for the analog input signal AIN). As a result, the capacitor 33 holds the difference between the logic threshold voltage of the inverter 13 and the inverted output voltage of the differential amplifier 18 with the initial voltage Vi provided to the positive-side input terminal and the input voltage Va provided to the negative-side input terminal, whereas the capacitor 35 holds the difference between the input voltage Va and the initial voltage Vi.

During the writing period, when the output voltage of the inverter 13 is lower than the input voltage Va, the negative-side input voltage of the differential amplifier 18 falls, so that the inverted output voltage of the differential amplifier 18 falls, and the output voltage of the inverter 13 rises. On the other hand, when the output voltage of the inverter 13 is higher than the input voltage Va, the negative-side input voltage of the differential amplifier 18 rises, so that the inverted output voltage of the differential amplifier 18 rises, and the output voltage of the inverter 13 falls. In this manner, the output voltage of the inverter 13 rises when it is lower than the input voltage Va, and falls when higher than the input voltage Va, with the result that it ultimately becomes equal to the input voltage Va.

Therefore, as with the amplifier circuit 6, the amplifier circuit 7 makes it possible to enhance the stability and the low-power-consumption capability of the amplifier circuit, while maintaining the slew rate.

Fifth Embodiment

Figure 16:
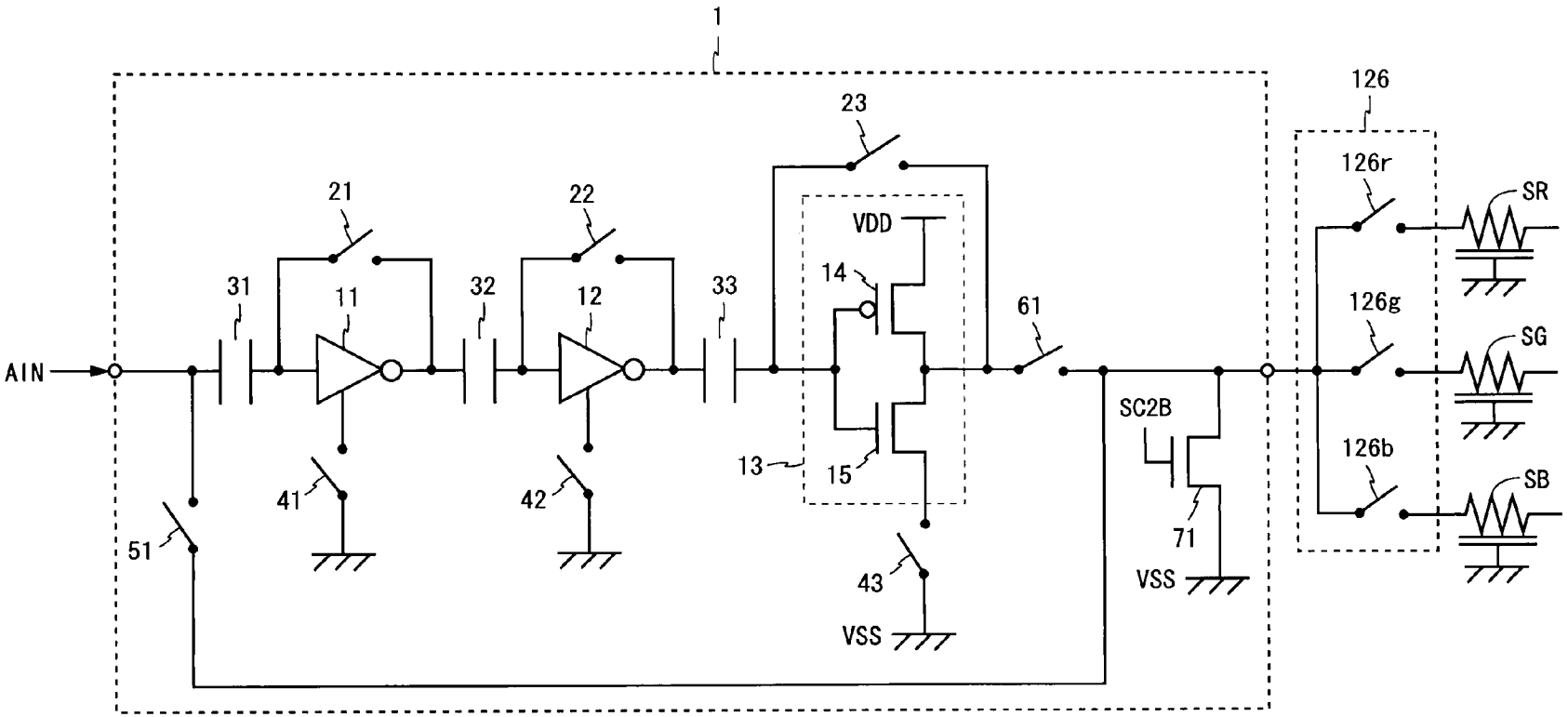
FIG. 16 is a circuit diagram illustrating a usage pattern of an amplifier circuit in a liquid crystal display device according to a fifth embodiment of the present invention.

A fifth embodiment will be described with respect to other usage patterns of the amplifier circuits according to the embodiments. The following description will be given with respect to an example where the amplifier circuit 1 according to the first embodiment is used to drive three data signal lines SR, SG, and SB in a time-division manner. To drive the three data signal lines SR, SG, and SB in a time-division manner, selection switches 126*r*, 126*g*, and 126*b* may be provided between the amplifier circuit 1 and the data signal lines SR, SG, and SB, as shown in FIG. 16, such that one of them can be selectively controlled to be brought into "ON" state.

Figure 17:
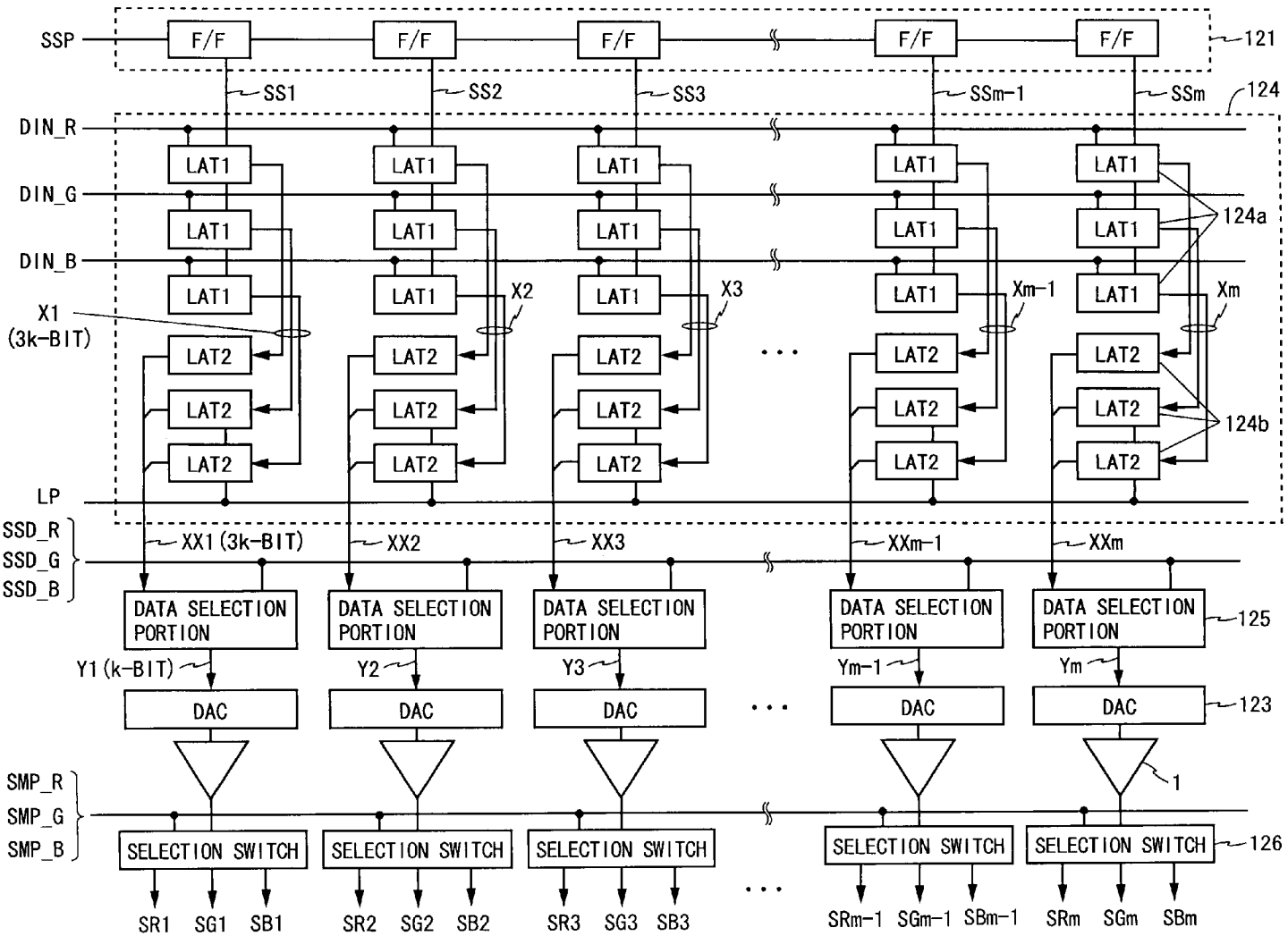
FIG. 17 is a block diagram illustrating the configuration of a data signal line drive circuit included in the liquid crystal display device according to the fifth embodiment of the present invention.

FIG. 17 is a block diagram illustrating a detailed configuration of a data signal line drive circuit according to the present embodiment. In the data signal line drive circuit shown in FIG. 17, three k-bit input-side latches 124*a*, three k-bit output-side latches 124*b*, a data selection portion 125, a D/A converter 123, an amplifier circuit 1, and selection switches 126 are provided in association with each stage of a shift register 121.

Figure 18:
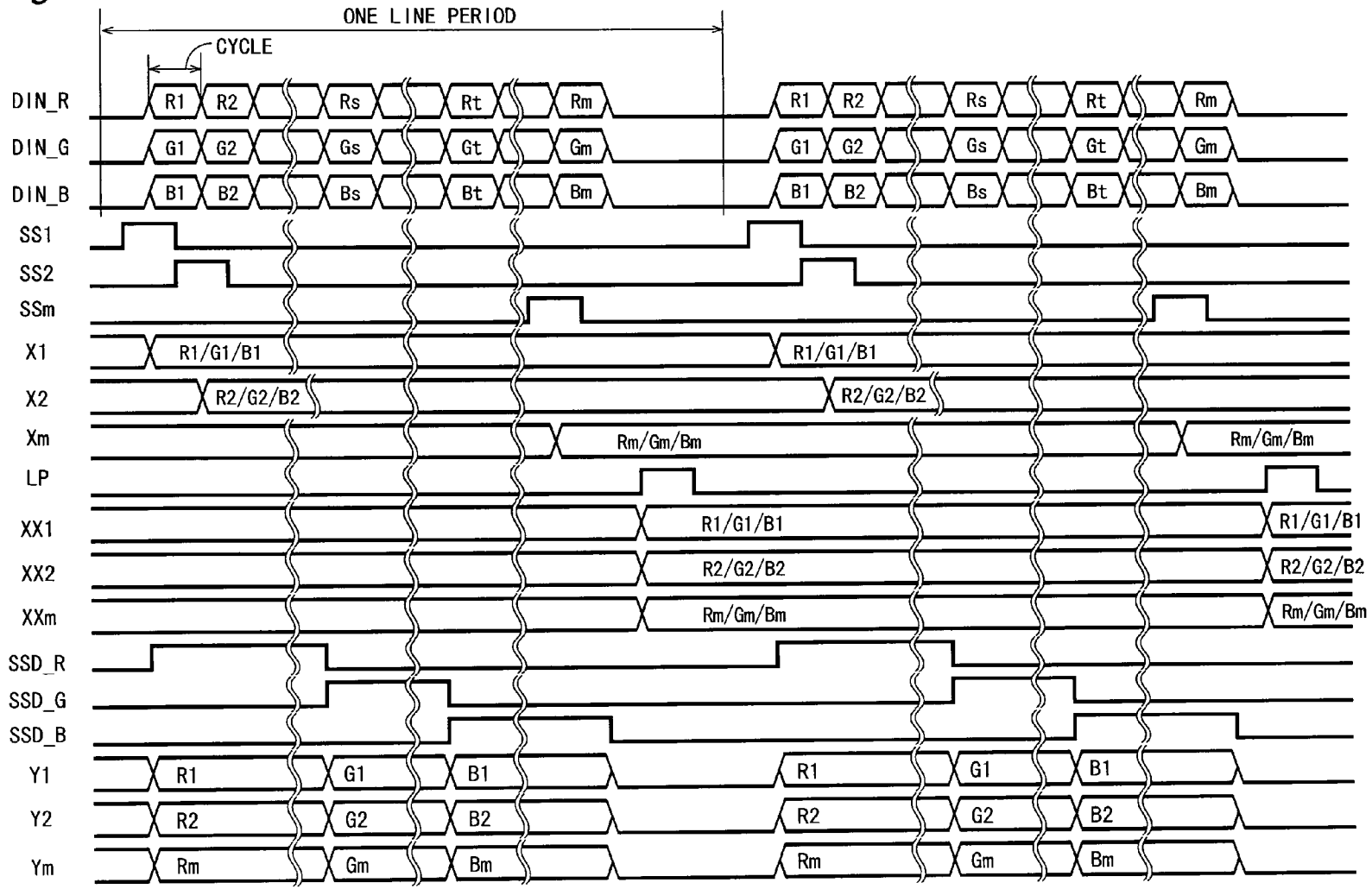
FIG. 18 is a timing chart for the data signal line drive circuit shown in FIG. 17.

FIG. 18 is a timing chart for the data signal line drive circuit according to the present embodiment. As shown in FIG. 18, three digital video signals DIN_R, DIN_G, and DIN_B, which change per cycle, are supplied in parallel to the data signal line drive circuit. The three input-side latches 124*a* at the ith stage memorize the digital video signals DIN_R, DIN_G, and DIN_B when an output signal SSi from the shift register 121 changes from high to low level. After 3m digital video signals are inputted, a latch pulse LP is brought into high level for one cycle, and the 3m digital video signals memorized in 3m input-side latches 124*a* are collectively transferred to 3m output-side latches 124*b*.

Inputted to the ith data selection portion 125 are three digital video signals (3 k bits in total) outputted from three output-side latches 124*b* at the ith stage, and selection control signals SSD_R, SSD_G, and SSD_B. The selection control signals SSD_R, SSD_G, and SSD_B are brought into high level for a predetermined time period once within one line period, and the ith data selection portion 125 selects and outputs one (k bits) of the three digital video signals in accordance with the selection control signals SSD_R, SSD_G, and SSD_B. Accordingly, within one line period, the three digital video signals are sequentially selected and outputted from the ith data selection portion 125.

The ith D/A converter 123 converts the digital video signal outputted from the ith data selection portion 125 into an analog video signal. The output terminal of the ith amplifier circuit 1 is connected to three data signal lines SRi SGi and SBi via the selection switches 126. The ith amplifier circuit 1 amplifies the analog input signal outputted from the ith D/A converter 123, and drives any of the data signal lines SRi SGi and SBi based on the amplified signal.

Figure 19:
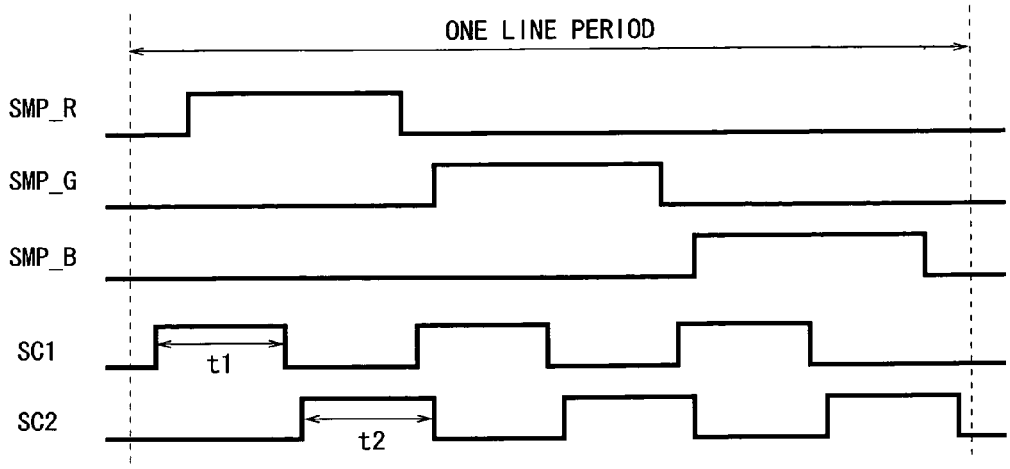
FIG. 19 is a timing chart for control signals supplied to an amplifier circuit and selection switches in the data signal line drive circuit shown in FIG. 17.

FIG. 19 is a timing chart for control signals supplied to the amplifier circuit 1 and the selection switches 126. The selection switches 126*r*, 126*g*, and 126*b* are brought into "ON" state when their respective sampling control signals SMP_R, SMP_G, and SMP_B are at high level. As with the selection control signals SSD_R, SSD_G, and SSD_B, the sampling control signals SMP_R, SMP_G, and SMP_B are brought into high level for a predetermined time period once within one line period. Thus, the data signal lines SRi SGi and SBi are sequentially selected and driven once within one line period.

As described above, the amplifier circuit 1 according to the first embodiment can also be used in a liquid crystal display device in which a plurality of data signal lines are driven in a time-division manner. The amplifier circuits 2 to 7 according to the second to fourth embodiments can also be used to configure similar liquid crystal display devices.

Note that several variants as described below can be configured for the amplifier circuit and the display device of the present invention. In the amplifier circuits according to the first to fourth embodiments, the initial setting switch 71 is provided between the signal line SL and the low level source voltage VSS to select whether or not to supply the low level source voltage VSS to the signal line SL, but alternatively, it may be provided between the signal line SL and the high level source voltage VDD to select whether or not to supply the high level source voltage VDD to the signal line SL. In this case, unlike in the first to fourth embodiments, a transistor having a lower current drive capability than the N-type transistor 15 is used as the P-type transistor 14 having a source terminal supplied with the high level source voltage VDD.

Also, the amplifier circuits according to the first to third embodiments include amplifying portions each having three inverters cascaded, but the number of inverters included in the amplifying portion may be arbitrary so long as it is an odd number. In addition, while the third embodiment has been described with respect to the case where the capacitor 34 having a predetermined capacitance value is provided to the amplifier circuit 2 according to the second embodiment (or an inverter having a predetermined logic threshold voltage is used as the first-stage inverter 11), a similar approach may be applied to the amplifier circuit 1 according to the first embodiment.

Figure 20:
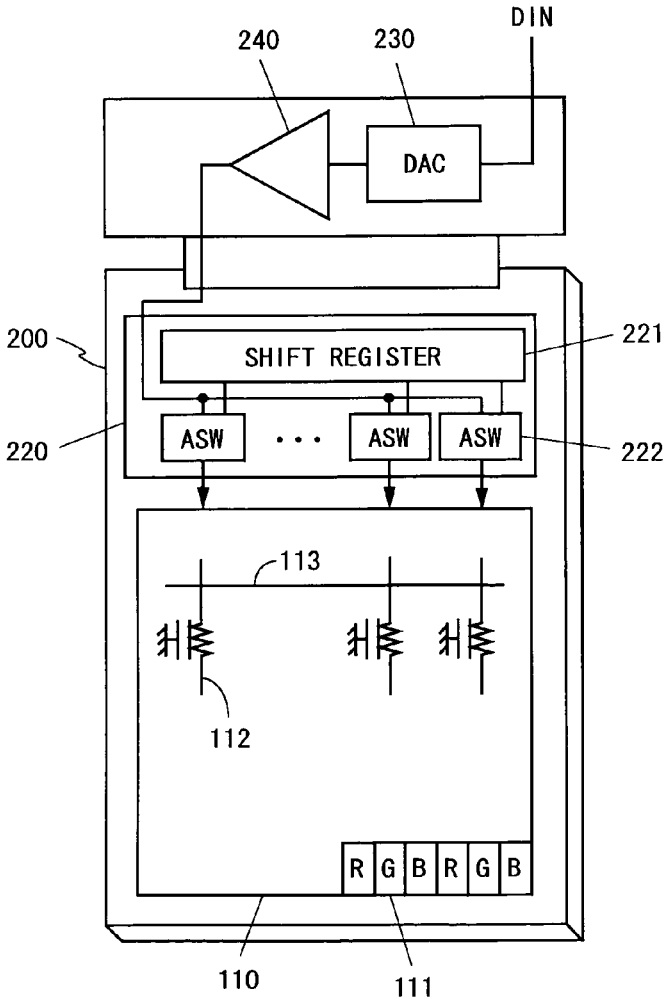
FIG. 20 is a block diagram illustrating another usage pattern of the amplifier circuit of the present invention.

Furthermore, the amplifier circuit according to each embodiment of the present invention may be used for driving data signal lines in a liquid crystal display device shown in FIG. 20. In the liquid crystal display device shown in FIG. 20, a pixel array 110, a shift register 221 and analog switches 222, which constitute a part 220 of a data signal line drive circuit, and a scanning signal line drive circuit (not shown) are integrally formed on a liquid crystal panel 200. A D/A converter 230 and an amplifier circuit 240, which constitute the remaining part of the data signal line drive circuit, are provided outside the liquid crystal panel 200. In this manner, the amplifier circuit according to each embodiment of the present invention may be provided outside the liquid crystal panel. In addition, the amplifier circuit according to each embodiment of the present invention may be used for driving the data signal lines in a dot-sequential manner. Moreover, the amplifier circuit according to each embodiment of the present invention may be used for driving data signal lines of display devices other than the liquid crystal display device (e.g., an organic electroluminescence display device).

INDUSTRIAL APPLICABILITY

The amplifier circuit of the present invention is characterized by stably operating with low power consumption while maintaining the slew rate, and therefore can be widely used in circuits for amplifying analog input signals to drive signal lines (e.g., a data signal line drive circuit in a liquid crystal display device).

The invention claimed is:

1. An amplifier circuit for amplifying an analog input signal and driving a signal line based on the amplified signal, the circuit comprising:

an amplifying portion including a plurality of cascaded amplifiers and negatively feeding back an output signal from a last-stage amplifier to an input to a first-stage amplifier;

a separation switch for selecting whether or not to supply an output signal from the amplifying portion to the signal line; and an initial setting switch for selecting whether or not to supply a first source voltage to the signal line, wherein the amplifying portion includes, an odd number of cascaded logical negation circuits, each serving as an amplifier;

threshold setting switches provided in association with their respective logical negation circuits, excluding the last-stage logical negation circuit, for selecting whether or not to short-circuit input and output terminals of each logical negation circuit;

a feedback control switch for selecting whether or not to feed back an output signal from the last-stage logical negation circuit to an input to the first-stage logical negation circuit;

a first-stage capacitive element provided between an input terminal for the analog input signal and the input terminal of the first-stage logical negation circuit;

an interstage capacitive element provided between the input terminal of the logical negation circuits other than the first-stage and last-stage logical negation circuits, and the output terminal of its previous-stage logical negation circuit;

an input capacitive element having an electrode connected to the input terminal of the first-stage logical negation circuit and another electrode supplied with a constant voltage, wherein, the last-stage logical negation circuit includes a first transistor of a first conduction type having a source terminal supplied with the first source voltage and a gate terminal supplied with an output signal from a previous-stage amplifier, and a second transistor of a second conduction type having a source terminal supplied with a second source voltage and a gate terminal supplied with the same output signal from the previous-stage amplifier, the first transistor has a lower current drive capability than the second transistor, and the input capacitive element has a capacitance value not allowing the threshold setting switch associated with the first-stage logical negation circuit to be rendered conductive when the feedback control switch is rendered conductive, provided that the analog input signal is at a level within a predetermined range.

2. The amplifier circuit according to claim 1, wherein the first transistor has a lower channel width-to-length ratio than the second transistor.

3. The amplifier circuit according to claim 1, wherein the second-from-last-stage logical negation circuit included in the amplifying portion includes a third transistor of the first conduction type having a source terminal supplied with the first source voltage and a gate terminal supplied with an output signal from a previous-stage amplifier, and a fourth transistor of the second conduction type having a source terminal supplied with the second source voltage and a gate terminal supplied with the same output signal from the previous-stage amplifier, and wherein the third transistor has a lower current drive capability than the fourth transistor.

4. The amplifier circuit according to claim 1, wherein the separation switch is made up of a single transistor having a conductive terminal connected to a drain terminal of the first transistor and another conductive terminal connected to a drain terminal of the second transistor.

5. The amplifier circuit according to claim 1, wherein the separation switch is made up of a single transistor having a conductive terminal supplied with the second source voltage and another conductive terminal connected to a drain terminal of the second transistor.

6. A matrix-type display device comprising:

a plurality of two-dimensionally arranged pixel circuits;

a plurality of data signal lines commonly connected to the pixel circuits arranged in a same column; and a data signal line drive circuit including an amplifier circuit according to claim 1, and driving the data signal lines using the amplifier circuit.

7. An amplifier circuit for amplifying an analog input signal and driving a signal line based on the amplified signal, the circuit comprising:

an amplifying portion including a plurality of cascaded amplifiers and negatively feeding back an output signal from a last-stage amplifier to an input to a first-stage amplifier;

a separation switch for selecting whether or not to supply an output signal from the amplifying portion to the signal line; and an initial setting switch for selecting whether or not to supply a first source voltage to the signal line, wherein the amplifying portion includes, a logical negation circuit serving as the last-stage amplifier;

a threshold setting switch for selecting whether or not to short-circuit input and output terminals of the logical negation circuit;

a differential amplifier for inverting and amplifying the difference between the analog input signal and an output signal from the logical negation circuit;

a feedback control switch for selecting whether or not to provide the output signal from the logical negation circuit to the differential amplifier;

an interstage capacitive element provided between an inverted output terminal of the differential amplifier and the input terminal of the logical negation circuit;

a first-stage capacitive element having an electrode connected to a negative-side input terminal of the differential amplifier;

an amplifier control switch for selecting whether or not to short-circuit the negative-side input terminal and a non-inverted output terminal of the differential amplifier; and an input control switch for selecting whether or not to provide the analog input signal to another electrode of the first-stage capacitive element, wherein, the logical negation circuit includes a first transistor of a first conduction type having a source terminal supplied with the first source voltage and a gate terminal supplied with an output signal from a previous-stage amplifier, and a second transistor of a second conduction type having a source terminal supplied with a second source voltage and a gate terminal supplied with the same output signal from the previous-stage amplifier, and the first transistor has a lower current drive capability than the second transistor.

8. The amplifier circuit according to claim 7, wherein the first transistor has a lower channel width-to-length ratio than the second transistor.

9. A matrix-type display device comprising:

a plurality of two-dimensionally arranged pixel circuits;

a plurality of data signal lines commonly connected to the pixel circuits arranged in a same column; and a data signal line drive circuit including an amplifier circuit according to claim 7, and driving the data signal lines using the amplifier circuit.

10. An amplifier circuit for amplifying an analog input signal and driving a signal line based on the amplified signal, the circuit comprising:

an amplifying portion including a plurality of cascaded amplifiers and negatively feeding back an output signal from a last-stage amplifier to an input to a first-stage amplifier;

a separation switch for selecting whether or not to supply an output signal from the amplifying portion to the signal line; and an initial setting switch for selecting whether or not to supply a first source voltage to the signal line, wherein the amplifying portion includes, a logical negation circuit serving as the last-stage amplifier;

a threshold setting switch for selecting whether or not to short-circuit input and output terminals of the logical negation circuit;

a differential amplifier for inverting and amplifying the difference between the analog input signal and an output signal from the logical negation circuit;

a feedback control switch for selecting whether or not to provide the output signal from the logical negation circuit to the differential amplifier;

an interstage capacitive element provided between an inverted output terminal of the differential amplifier and the input terminal of the logical negation circuit;

a first-stage capacitive element having an electrode connected to a positive-side input terminal of the differential amplifier and another electrode provided with the analog input signal;

an amplifier control switch for selecting whether or not to short-circuit the positive-side input terminal and the inverted output terminal of the differential amplifier; and an input control switch for selecting whether or not to provide the analog input signal to a negative-side input terminal of the differential amplifier, wherein, the logical negation circuit includes a first transistor of a first conduction type having a source terminal supplied with the first source voltage and a gate terminal supplied with an output signal from a previous-stage amplifier, and a second transistor of a second conduction type having a source terminal supplied with a second source voltage and a gate terminal supplied with the same output signal from the previous-stage amplifier, and the first transistor has a lower current drive capability than the second transistor.

11. The amplifier circuit according to claim 10, wherein the first transistor has a lower channel width-to-length ratio than the second transistor.

12. A matrix-type display device comprising:

a plurality of two-dimensionally arranged pixel circuits;

a plurality of data signal lines commonly connected to the pixel circuits arranged in a same column; and a data signal line drive circuit including an amplifier circuit according to claim 10, and driving the data signal lines using the amplifier circuit.

* * * * *